US008002397B2

(12) United States Patent
Udagawa et al.

(10) Patent No.: US 8,002,397 B2
(45) Date of Patent: Aug. 23, 2011

(54) INK CONTAINER, INK CONTAINER SET, AND INK JET RECORDING APPARATUS

(75) Inventors: Kenta Udagawa, Yokohama (JP); Soji Kondo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 524 days.

(21) Appl. No.: 12/065,505

(22) PCT Filed: Nov. 29, 2006

(86) PCT No.: PCT/JP2006/324301
§ 371 (c)(1),
(2), (4) Date: Feb. 29, 2008

(87) PCT Pub. No.: WO2007/064016
PCT Pub. Date: Jun. 7, 2007

(65) Prior Publication Data

US 2009/0290003 A1 Nov. 26, 2009

(30) Foreign Application Priority Data

Nov. 30, 2005 (JP) ..... 2005-346563

(51) Int. Cl.
*B41J 2/175* (2006.01)
*B41J 2/21* (2006.01)

(52) U.S. Cl. ..... 347/86; 347/43

(58) Field of Classification Search ..... 347/7, 86, 347/43
See application file for complete search history.

(56) References Cited

U.S. PATENT DOCUMENTS

| | | | | |
|---|---|---|---|---|
| 4,680,696 | A | 7/1987 | Ebinuma et al. | 346/75 |
| 5,359,357 | A | 10/1994 | Takagi et al. | 347/49 |
| 6,097,405 | A | 8/2000 | Lo et al. | 347/6 |
| 6,145,972 | A | 11/2000 | Udagawa et al. | 347/86 |
| 6,293,649 | B1 | 9/2001 | Norton | 347/37 |
| 6,350,025 | B1 | 2/2002 | Morita et al. | 347/86 |
| 6,416,173 | B2 | 7/2002 | Kishida et al. | 347/86 |
| 6,471,333 | B1 | 10/2002 | Powell et al. | 347/49 |
| 6,702,427 | B2 | 3/2004 | Shimizu et al. | 347/50 |
| 7,029,105 | B2 | 4/2006 | Matsuba et al. | 347/86 |

(Continued)

FOREIGN PATENT DOCUMENTS

JP 60-137660 7/1985

(Continued)

OTHER PUBLICATIONS

Office Action dated Nov. 11, 2008 from corresponding Taiwan Application No. 95144422, and English language translation thereof.

*Primary Examiner* — Geoffrey Mruk
(74) *Attorney, Agent, or Firm* — Fitzpatrick, Cella, Harper & Scinto

(57) ABSTRACT

An ink container detachably mountable to an ink jet recording apparatus includes an ink accommodating portion accommodating ink; a casing accommodating the ink accommodating portion; an ink supplying portion for supplying the ink from the ink reservoir portion; a displaceable member which is provided in the casing and which is displaceable between an insertable position where the ink container is insertable into and extractable from the ink jet recording apparatus and a non-insertable position where the ink container is not insertable into and is not extractable from the ink jet recording apparatus, wherein the displaceable member is non-self-restorable with respect to the displacement.

7 Claims, 17 Drawing Sheets

U.S. PATENT DOCUMENTS

| | | | | |
|---|---|---|---|---|
| 7,290,861 | B2 | 11/2007 | Inoue et al. | 347/49 |
| 2003/0156172 | A1 | 8/2003 | Matsuba et al. | 347/86 |

FOREIGN PATENT DOCUMENTS

| | | | |
|---|---|---|---|
| JP | 10-109429 | | 4/1998 |
| JP | 11-170567 | | 6/1999 |
| JP | 2002-234178 | | 8/2002 |
| JP | 2003-25608 | | 1/2003 |
| JP | 2003-34040 | | 2/2003 |
| JP | 2003-237038 | | 8/2003 |
| JP | 2003-237101 | | 8/2003 |
| WO | WO 2005/120838 | A1 * | 12/2005 |
| WO | 2007/066789 | | 6/2007 |

* cited by examiner (a)

(b)

(a)

(b)

(a)

(b)

(a)

(b)

(a)

(b)

(a)

(b)

INK CONTAINER, INK CONTAINER SET, AND INK JET RECORDING APPARATUS

TECHNICAL FIELD

The present invention relates to an ink container used for ink jet recording, an ink container set made up of multiple ink containers, and an ink jet recording apparatus in which an ink container or an ink container set are mounted. In particular, the present invention relates to: an ink container provided with a displaceable member for controlling the insertion of the ink container into an ink jet recording apparatus, and the extraction of the ink container from the ink jet recording apparatus; an ink container set made up of multiple ink containers, which allows the displaceable members thereof to properly function; and an ink jet recording apparatus provided with a means capable of determining whether or not the ink containers in the recording apparatus match in ink properties, and whether or not they are allowed to be extracted, based on the position of the displaceable member.

BACKGROUND ART

One of the various types of ink jet recording apparatuses is the so-called serial type. When an ink jet recording apparatus of this type forms an image, not only does it reciprocally moves its recording head in a preset direction (primary scan direction) in a manner of scanning recording medium, but also, it conveys the recording medium in the direction perpendicular to the direction in which it moves the recording head. One of the methods for supplying the recording head of an ink jet recording apparatus of the serial type with ink is the so-called "on-carriage method". According to this method, an ink container is separably or inseparably attached to a recording head mounted on a carriage or the like, and supplies the recording head with ink while the recording head (carriage) is reciprocally moved (in primary scan direction). There is another ink supplying method called off-carriage method for supplying the recording head of an ink jet recording apparatus with ink. According to this method, an ink container is not attached to a recording head which is to be mounted on a carriage. That is, the ink container is solidly anchored to a preset part of a recording apparatus, and is connected to the recording head with the use of a piece of flexible tube or the like to supply the recording head with ink.

In the case of the ink supplying method of the "on-carriage type", an ink container is moved in the primary scan direction, during an image forming operation. Therefore, it is impossible to replace an ink container during an image forming operation. Further, in order to prevent the ink container of an ink jet recording of the "on-carriage type" from being carelessly replaced at a non-scheduled point in time (even when the ink jet recording apparatus is on standby), the carriage of an ink jet recording apparatus of the "on-carriage type" is positioned so that the ink containers on the carriage is not replaceable unless it is moved to a preset location at which the ink containers are allowed to be replaced. Thus, the normal procedure for replacing the ink containers in an ink jet recording apparatus of the "on-carriage type" is as follows: A user is to give an ink container replacement command to the ink jet recording apparatus. Upon reception of the command, the ink jet recording apparatus moves its carriage to a location called "ink container replacement point", where the ink container replacement operation can be easily carried out. Then, the apparatus prompts the user to replace the ink containers on the carriage.

In the case of an ink supplying method of the "off-carriage type", an ink container is solidly anchored to a preset area of the recording apparatus. Therefore, not only is it possible to replace the ink container while the recording apparatus is not being used for recording, but also, it is sometimes possible to replace the ink container while the recording apparatus is being used for recording. Thus, some ink jet recording apparatuses of this type are designed so that they continuously watch whether or not it is safe for the ink containers in the recording apparatuses to be replaced at a given moment, in order to prevent an ink container replacement operation from causing the recording apparatuses to malfunction, whereas some are provided with a mechanism capable of preventing the ink containers in the recording apparatus from being carelessly replaced, in order to ensure, by properly controlling this mechanism, that the normal recording operation continues.

FIG. 19 is a schematic drawing of an example of an ink jet recording apparatus of the "off-carriage type", and FIG. 20 is a schematic drawing of another example of an ink jet recording apparatus of the "off-carriage type". In the two drawings, a referential numeral 100 designates a recording apparatus 1, and a referential numeral 102 designates an ink container mounted in the ink container bay 101 of the main assembly of the recording apparatus 1. Designated by a referential numeral 103 is a sheet feeder section for feeding recording medium into the main assembly, and designated by a referential numeral 104 is a sheet delivery section, into which recording medium is discharged after the completion of the image formation on the recording medium. FIG. 19 shows an example of an ink jet recording apparatus of the "off-carriage type", in which four ink containers 102 are mounted so that the four ink container 100 horizontally align in parallel. On the other hand, FIG. 20 shows an example of an ink jet recording apparatus of the "off-carriage type", in which four ink containers 102 are differently mounted from the way they are mounted in the apparatus shown in FIG. 19. That is, this apparatus is provided with two ink container bays (101): left- and right-hand ink container bays located in a manner of sandwiching the sheet feeder section 103. The two of the four ink containers are vertically stacked in the left-hand ink container bay, whereas the other two are vertically stacked in the right-hand ink container bay.

From the standpoint of preventing an ink jet recording apparatus from being made to malfunction by the careless ink container replacement, even an ink jet recording apparatus of the "off-carriage type", such as the above described one, is desired to be designed so that the timing and location for ink container replacement remain under the control of the recording apparatus. In particular, in the case of an ink jet recording apparatus of the "off-carriage type", the ink lines which connects the ink containers and recording head are relatively long. Therefore, it is desired to minimize the length of time a user has to wait while a performance restoration operation, such as the operation for removing the bubbles having entered the ink lines due to the careless ink container replacement, is carried out, and/or to minimize the amount by which waste ink is increased by the performance restoration operation. Therefore, even an ink jet recording apparatus of the "off-carriage type" is desired to be designed so that when it is possible for problems, such as the abovementioned bubble entry into the ink line, to occur, the apparatus executes a proper control for blocking the ink container removal operation.

Recent ink jet recording apparatuses are highly advanced in terms of image resolution and printing speed. Therefore, it has become very important to keep the performance of an ink jet recording apparatus at its original level. Thus, it has come to be strongly desired to strictly control the operation for mounting a recording head and ink containers. Japanese Laid-open Patent Application 2003-237038, for example, discloses an ink jet recording apparatus in which the bubble entry into the ink lines is prevented by the combination of a holding member and a separation preventing means.

The methods for preventing the ink containers in the ink jet recording apparatus from being replaced, can be roughly classified into two groups: the group in which an ink container itself is solidly attached to an ink jet recording apparatus, and the group in which an ink container bay is provided with a lid which is controlled in opening and closing movements. There are products which detect the movement of the abovementioned lid and warn a user, although it does not control the opening and closing movements of the lid. In the case of an ink jet recording of this type, an ink container can be removed by a user in spite of the warning. Therefore, after the careless removal of an ink container, it is mandatory that an operation of restoring the performance of an ink jet recording apparatus to its normal level is carried out.

In order to ensure that an ink jet recording apparatus forms an image which is accurate in color, the order in which its recording heads, that is, black, cyan, magenta, and yellow color recording heads, for example, are arranged is preset. Accordingly, the ink containers which store the inks of these colors, one for one, are mounted in the corresponding ink container slots, in the ink container bay, which are arranged in the order preset according to the order in which the recording heads are arranged. Usually, the insertion of a wrong ink container is prevented by a method, such as those shown in Japanese Laid-open Patent Applications 2002-234178, 2003-25608, 2003-34040, etc. That is, each ink container is provided with a claw for preventing the ink container from being inserted into a wrong slot, whereas each ink container slot of the ink container bay of an ink jet recording apparatus is also provided with a catch for preventing an ink container from being inserted or anchored in a wrong slot. Further, the shape of the claw is rendered peculiar to the type of the ink to be stored therein, and the shape of the catch is rendered peculiar to the type of the ink container to be mounted therein.

Recently, some ink jet recording apparatuses are designed so that they can be changed in the ink container combination according to their usage. Thus, even an ink jet recording apparatus which are designed to use multiple ordinary inks different in color is sometimes used with a combination of ink containers which contain special inks, one for one, for example, inks which are less susceptible to their ambience, inks which are superior in chromatic characteristic, inks which have been adjusted in properties, such as surface tension, according to the properties of the recording medium, the like. Moreover, sometimes, the original set of ink containers in an ink jet recording apparatus is replaced with a set of ink containers which came into the market and contains inks superior in properties to the inks in the original set.

In any of the abovementioned cases, that is, the cases in which a combination of a claw and catch, such as the above described one, is employed to prevent a wrong ink container from being mounted, it is not according to the ink properties, such as susceptibility to ambience or chromaticity, that the ink container slots in the ink container bay of the ink jet recording apparatus are arranged in a preset order. Instead, the ink container slots are arranged in the order based on ink color. Therefore, any of the ink containers which are identical in the color (cyan, for example) of the ink therein, can be mounted into the ink container slot designated for the ink container of this color (cyan, for example), regardless of the properties, such as the abovementioned ones, other than color. Thus, even if it is desired that a combination of ink containers, which is specific in terms of one of the ink properties other than chromatic properties, is mounted, it is possible that one or more ink containers which are correct in terms of the color of the ink therein, but wrong in terms of the specific property, will be mounted. If a situation, such as the above descried one, occurs, multiple inks different in terms of the specified property are mixed as an image is formed, failing thereby to yield an image which displays the desired characteristics.

On the other hand, Japanese Laid-open Patent Application 10-109429 discloses an ink jet recording apparatus structure which determines whether or not an ink container is in the ink container bay, and whether or not an ink container in the ink container bay is a correct one, by providing ink containers with a light passage. Further, Japanese Laid-open Patent Application 2003-237101 discloses an ink jet recording apparatus structure which determines whether or not an ink container is in the ink container bay, and whether or not an ink container in the ink container bay is a correct one, by the provision of electrical contacts. It is possible to detect the state of the ink containers mounted in an ink jet recording apparatus, by employing the ink jet recording structures disclosed in these patent documents, that is, by providing the ink containers with a light passage or electrical contacts designed, in terms of positional relationship, so that only when all the ink containers in the ink jet recording apparatus match in ink properties, optical or electrical connection is established throughout all the ink containers in the recording apparatus. However, the abovementioned structures cannot prevent a wrong ink container from being mounted into an ink jet recording apparatus. However, they make it possible determine that if optical or electrical connection is not established, at least one of the ink containers in the apparatus is a wrong one. Therefore, the abovementioned problem that inks different in a specific property (or specific properties) are mixed can be prevented by not carrying out an image forming operation, if optical or electrical connection is not established. In practical terms, therefore, it may be said that the abovementioned ink jet apparatus structures can prevent the problem that inks different in a specific property (or specific properties) are mixed, because the abovementioned ink jet apparatus structures make it possible to prevent an image forming operation from being started when a wrong ink container is in an ink jet recording apparatus.

Recently, in the field of an ink jet recording apparatus, not only a large number of inks different in color, but also, various ink containers which are substantially larger in size, have come to be used. Therefore, an ink jet recording apparatus of the "on-carriage type" has increased in the total weight of ink containers mounted on a carriage. Further, it has become impossible to ignore the effects of the increase in the size of the space necessary for the carriage to be reciprocally moved in the primary scan direction while holding ink containers. Thus, the effects which the employment of the ink supplying method of the "off-carriage type" has upon the main assembly of an ink jet recording apparatus in terms of size reduction have come to be reconsidered. Also, from the standpoint of strictly controlling a recent ink jet recording head which is more accurate in chromaticity and higher in recording speed than an ink jet recording apparatus in accordance with the prior art, it is strongly desired that even an ink jet recording apparatus of the "off-carriage type" is designed to prevent a user from carelessly replacing an ink container in an ink jet recording apparatus while the apparatus is operated, or in the like situation, as described above. Also recently, user demand has diversified (whether to prioritize the insusceptibility to ambience, the accuracy in chromaticity, or the like factor), and ink technologies have drastically advanced. Therefore, it has come to be strongly desired that the main assembly side of an ink jet recording apparatus is structured to enable the main assembly to accommodate various types of ink container sets.

Moreover, in consideration of the fact that an ink recording apparatus is widely used, that is, an ink jet recording apparatus is used by various user, it is strongly desired that not only is an ink jet recording apparatus properly structured to meet user demand, but also, to eliminate the possibility that the apparatus will be erroneously operated by a user. Therefore, it has become very important that when an ink container is mounted into an ink jet recording apparatus, the type of the ink container can be reliably detected to prevent the problem that a wrong ink container is used.

However, a structural arrangement, such as those disclosed in Japanese Laid-open Patent Applications 2002-234178, 2003-25608, 2003-34040, etc., in which a combination of a claw and a catch is provided for preventing an ink container bay from being fitted with a wrong ink container, is not suitable for dealing with multiple sets of ink container which are the same in ink color combination, but, are different in ink properties other than color. That is, it is problematic in that it cannot determine whether or not the ink containers in an ink jet recording apparatus match in ink properties, and therefore, cannot prevent inks different in properties from being used in mixture.

Further, even if a structural arrangement, such as those disclosed in Japanese Laid-open Patent Applications 2003-237101 and 10-109429, which can detect that at least one of the ink containers in an ink jet recording apparatus is a wrong ink container, based on the relationship among the multiple ink containers in the ink jet recording apparatus, is employed, it is impossible to prevent an ink container or ink containers in the ink jet recording apparatus from being removed before the ink jet recording apparatus is readied for the ink container removal. In other words, in order to prevent the ink containers in the ink jet recording apparatus from being removed before the ink jet recording apparatus is readied for the ink container removal, a mechanism dedicated to the prevention of the removal of the ink containers in the ink jet recording apparatus prior to the readying of the ink jet apparatus for the ink container removal is necessary. Further, in order to perform the operations necessary to examine the ink containers in an ink jet recording apparatus, the recording apparatus disclosed in Japanese Laid-open Patent Application 10-109429 requires an optical element made up of a light emitting element and a light receiving element, and the recording apparatus disclosed in Japanese Laid-open Patent Application 2003-237101 requires an electric circuit made up of electric contacts, etc., increasing thereby the apparatus cost by the amount necessary for the optical element and electric circuit, respectively.

It is feasible to provide an ink container with a storage element, such as an EEPROPM, in which information (color and other properties of ink in ink container) peculiar to the ink therein can be stored. In this case, an ink jet recording apparatus determines, by accessing the storage element, whether or a given ink container in the ink container bay is in the normal slot in the ink container bay, or whether or not a given ink container in the ink container bay is a correct one. However, this structural arrangement also requires an electric circuit made up of electrical contacts for establishing electrical connection between an ink container in an ink jet recording apparatus and the main assembly of the ink jet recording apparatus. In addition, it requires a separate mechanism for preventing the ink containers in the ink jet recording apparatus from being removed from the apparatus before the apparatus is readied for the ink container removal.

DISCLOSURE OF THE INVENTION

The present invention was made in consideration of the above described problems, and its primary object is to make it possible to determine whether or not the ink containers in an ink jet recording apparatus match in ink properties, and also, to prevent a wrong operation, such as the careless replacement of the ink containers in the ink jet recording apparatus, with the use of a simple structural arrangement.

Another object of the present invention is to make it possible to eliminate the problem that an ink jet recording apparatus is operated when the ink containers in the recording apparatus do not match in ink properties, with the use of a simple structural arrangement.

According to an aspect of the present invention, there is provided an ink container detachably mountable to an ink jet recording apparatus, comprising an ink accommodating portion accommodating ink; a casing accommodating said ink accommodating portion; an ink supplying portion for supplying the ink from said ink reservoir portion; a displaceable member which is provided in said casing and which is displaceable between an insertable position where said ink container is insertable into and extractable from the ink jet recording apparatus and a non-insertable position where said ink container is not insertable into and is not extractable from the ink jet recording apparatus, wherein said displaceable member is non-self-restorable with respect to the displacement.

According to another aspect of the present invention, there is provided a set of ink containers, each of said ink containers comprising: an ink accommodating portion accommodating ink; a casing accommodating said ink accommodating portion; an ink supplying portion for supplying the ink from said ink reservoir portion; a displaceable member which is provided in said casing and which is displaceable between an insertable position where said ink container is insertable into and extractable from the ink jet recording apparatus and a non-insertable position where said ink container is not insertable into and extractable from the ink jet recording apparatus, wherein said displaceable member is non-self-restorable with respect to the displacement, wherein in the insertable position, said displaceable member is retained in said casing, and in the non-insertable position, said displaceable member is retained projected out of said casing, and wherein a combination of said ink containers in said set is a predetermined combination, such that all of said displaceable members are movable in interrelation with each other.

According to a further aspect of the present invention, there is provided an ink jet recording apparatus comprising: a mounting portion for mounting a plurality of ink containers; wherein each of said ink containers is provided with an displaceable member which is provided in said casing and which is displaceable between an insertable position where said ink container is insertable into and extractable from the ink jet recording apparatus and a non-insertable position where said ink container is not insertable into and extractable from the ink jet recording apparatus; said apparatus further comprising, a urging member abuttable to said displaceable member to displace said displaceable member, wherein said displaceable members of the plurality of ink containers are movable in interrelation with each other, a receiving portion for receiving such one of displaceable members as is projected outwardly from said ink container; a detecting portion for detecting said displaceable member received by said receiving portion.

According to a further aspect of the present invention, the operation for inserting an ink container into an ink jet recording apparatus, or removing an ink container from the ink jet recording apparatus, can be regulated by the displacement of the displaceable member with which the ink container is provided, and therefore, the careless replacement of the ink containers in the ink jet recording apparatus can be prevented by the displacement of the displaceable member.

Also according to a further aspect of the present invention, each ink container is provided with a displaceable member, and an ink jet recording apparatus is structured so that multiple ink containers are juxtaposed in parallel in the main assembly of the ink jet recording apparatus. As the displaceable member of the most upstream ink container, in terms of the direction in which force is applied to displace the displaceable members of the multiple ink containers in the main assembly, is displaced by the pressure applied thereto by a pressing member with which the main assembly of the recording apparatus is provided, this displacement of the displaceable member of the most upstream ink container is sequentially transmitted to the displaceable member of the most downstream ink container, through the displaceable members of the in-between ink containers, causing the displaceable member of the most downstream ink container, only when the ink containers in the main assembly match in ink properties. Therefore, it is possible to determine whether or not the ink containers in the ink jet recording apparatus match in ink properties, and also, to prevent the wrong operation, such as the careless ink container replacement, by detecting whether or not the displaceable member of the most downstream ink container is protruding from the ink container. Further, the ink containers in accordance with the present invention are designed so that even if they are in their correct slots, one for one, in the ink container bay of an ink jet recording apparatus, the displaceable members of the adjacent two ink containers in the ink jet recording apparatus come into contact with each other, only when the two ink containers match in terms of the specific property (insusceptibility to ambience, chromaticity, etc.) of the inks therein. Therefore, it is possible to prevent the problem that an image forming operation is started when the ink containers in the ink jet recording apparatus do not match in ink properties.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the present invention will be described in detail with reference to the appended drawings.

Embodiment 1

Figure 1:
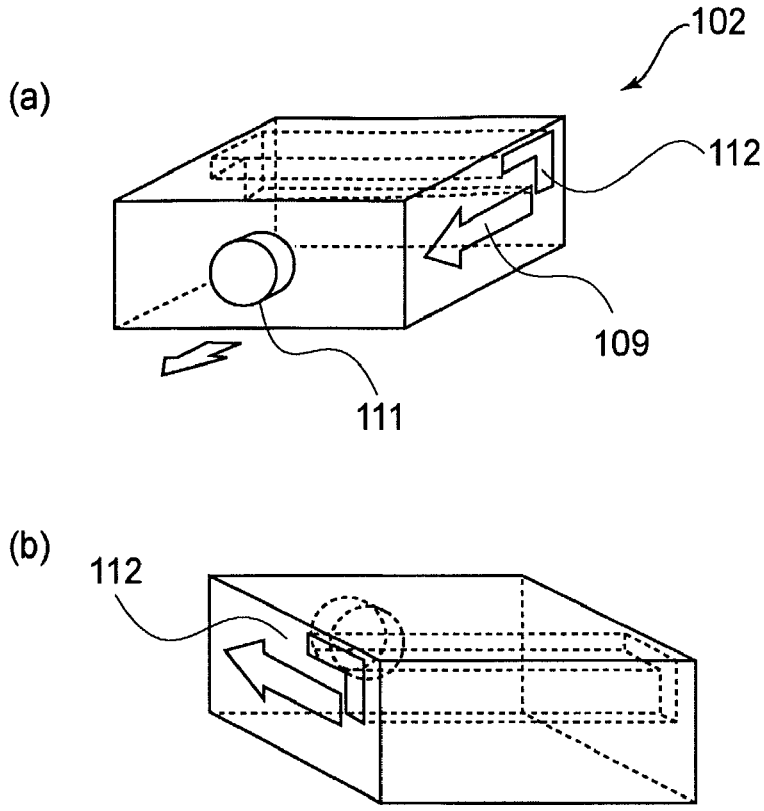
FIG. 1(*a*) is a perspective view of the ink container in the first embodiment of the present invention, as seen from the side of the ink container, which will be in contact with the recording apparatus after the mounting of the ink container into the recording apparatus, and FIG. 1(*b*) is a perspective view of the same ink container as that shown in FIG. 1(*a*), as seen from the side from which an ink jet recording apparatus is operated.
Figure 19:
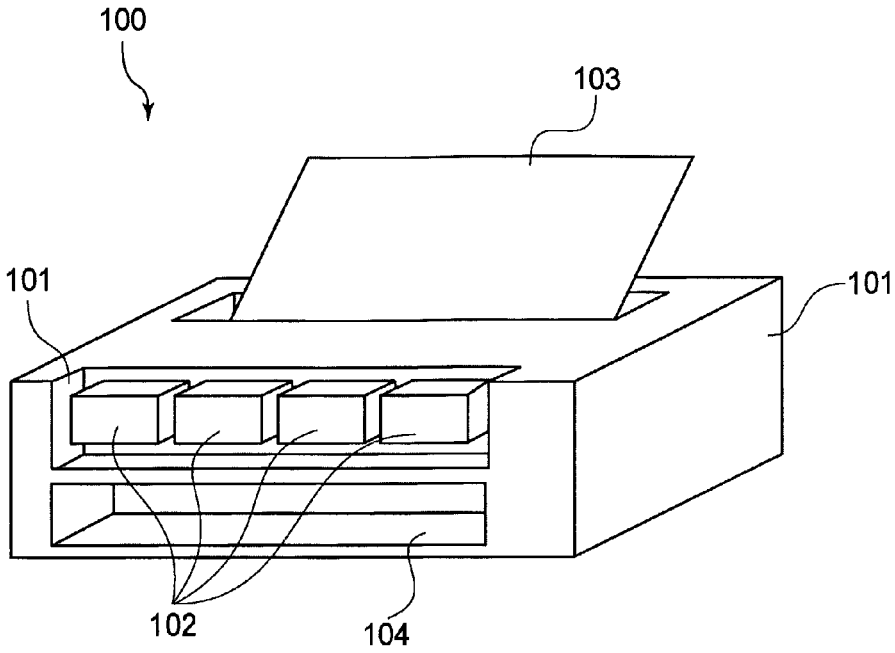
FIG. 19 is a perspective view of an example of a recording apparatus of the "off-carriage type", showing the configuration of its ink container bay.
Figure 20:
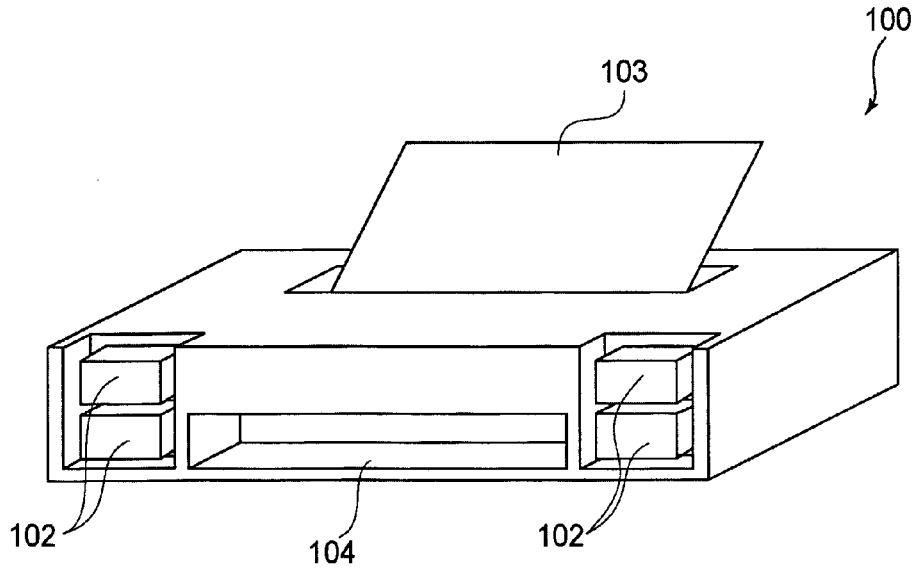
FIG. 20 is a perspective view of another example of a recording apparatus of the "off-carriage type", showing the configuration of its ink container bay.

FIGS. 1(*a*) and 1(*b*) show the ink container in the first embodiment of the present invention. FIG. 1(*a*) is a perspective view of the ink container, as seen from the side which comes into contact with a recording apparatus as it is mounted into the recording apparatus, and FIG. 1(*b*) is a perspective view of the ink container, as seen from the side from which it is mounted into the recording apparatus when a user operates the recording apparatus. The ink container 102 in this embodiment is configured to be usable with the ink jet recording apparatus shown in FIG. 19. When two or more (four in this embodiment) ink containers 102 are mounted into the recording apparatus, they are arranged in a straight line and in parallel to each other, in the ink container bay of the image forming apparatus, as shown in FIG. 2.

The ink container 102 has a spout 111, as an ink outlet, which is connected to the ink inlet portion (unshown) of the recording apparatus to supply the recording apparatus with ink. The spout 111 is on the surface of the ink container 102, which comes into contact with the recording apparatus as the ink container 102 is mounted into the recording apparatus. The ink container 102 in this embodiment also has a member 112, which extends from one lateral surface of the ink container 102 to the other, in terms of the direction in which the multiple ink containers 102 are aligned as described above. This member 112 is a slidable member, and is roughly L-shaped in cross section. Referring to FIG. 1(*a*), initially, the slidable member 112 is in the position (initial position) shown in the drawing. The ink container 102 is structured so that as the member 112 is pushed by one of its lengthwise ends, the member 112 moves into the position, shown in FIG. 1(*b*), in which the other lengthwise end portion of the member 112 protrudes from the ink container 102 as shown in FIG. 1(*b*). In other words, the ink container 102 is structured so that the member 112 is slidable. Hereinafter, the member 112 will be referred to as slidable member 112. Regarding the shape of the slidable member 112, obviously, the cross section of the slidable member 112 does not need to be limited to the one shown in the drawings, that is, it does need to be in the shape of a letter L or a hook.

The ink container 102 is to be handled so that its spouted surface faces the recording apparatus. In order to mount the ink container 102 into the recording apparatus, the ink container 102 is to be pushed into the recording apparatus in the direction indicated by an arrow mark 109 placed on one of the lateral surfaces of the ink container 102. In the case that four ink containers are mounted into an ink jet recording apparatus, such as the one shown in 19, as the four ink containers are inserted into the recording apparatus, they are horizontally juxtaposed in a straight line, in parallel to each other, as shown in FIG. 2, in which the four ink containers are designated by referential numerals 102*a* -102*d*, one for one, and their slidable members are designated by referential numerals 112*a* -112*d*, one for one. However, when it is unnecessary to differentiate the four ink containers and four slidable members, they will be simply referred to by referential numerals 102 and 112, respectively.

Figure 2:
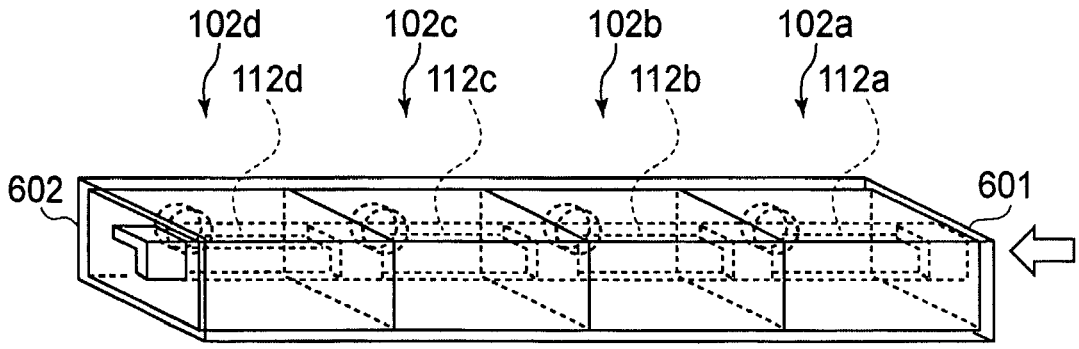
FIG. 2 is a perspective phantom view of the ink container bay in which multiple ink contains, such as the one shown in FIGS. 1(*a*) and 1(*b*), have been mounted.

Referring to FIG. 2, as the four ink containers 102*a*- 101*d* are mounted into the recording apparatus so that they are juxtaposed in a straight line in parallel to each other, the slidable member 112 of each ink container 102 is made to protrude in a preset direction. For example, the slidable member 112*a* of the ink container 102*a* is made to protrude toward the lateral surface of the adjacent ink container 102*b*, pushing the slidable member 112*b* of the ink container 102*b*, causing the slidable member 112*b* to protrude from the other lateral surface of the ink container 102*b*, which in turn causes the downstream end portion of the slidable member 102*c* to protrude toward the slidable member 102*c*, and so on. In other words, the force applied to the right-hand end (in FIG. 2) of the slidable member 112*a* is transmitted to the slidable member 102*d*, while causing the four slidable members 112 to protrude downward, in terms of the direction in which the force is applied, from the corresponding lateral surfaces, and intruding into the slidable member slots of the downstream ink containers, one for one.

The slidable member and the slidable member slot of each ink container are shaped and sized according to the properties (insusceptibility to ambience, chromaticity, etc.) of the ink with which each ink container is to be filled, so that the slidable member 112 of one of the adjacent two ink containers 102 in the ink container by of an ink jet recording apparatus is slidable into the slidable member slot of the other ink container 102, only when the two ink containers 102 match in the ink properties and are in their correct slots preset based on the color of the ink therein. In other words, when the adjacent two ink containers 102 in the ink container bay do not match in ink properties, or when one or both of the adjacent two ink containers 102 are incorrect in the order in which they are to be placed in the ink container bay based on color of the ink therein, their slidable members do not come into contact with each other. Therefore, the above described slidable member displacement does not occur; it does not occur that the end portion of the slidable member of one of the adjacent two ink containers protrudes into the slidable member slot of the other ink container while displacing the slidable member of the second ink container.

Figure 3:
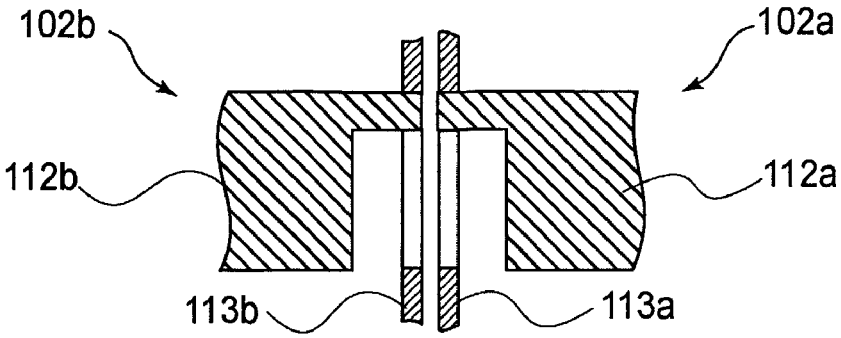
FIG. 3(*a*) is a schematic drawing of the displaceable members of the adjacent two ink containers, in the first embodiment, which are correctly arranged in the recording apparatus in terms of the order based on color, and match in the properties of the ink therein, before the displaceable members are displaced, and FIG. 3(*b*) is a schematic drawing of the same displaceable members as those in FIG. 3(*a*), after they were displaced.
Figure 3:
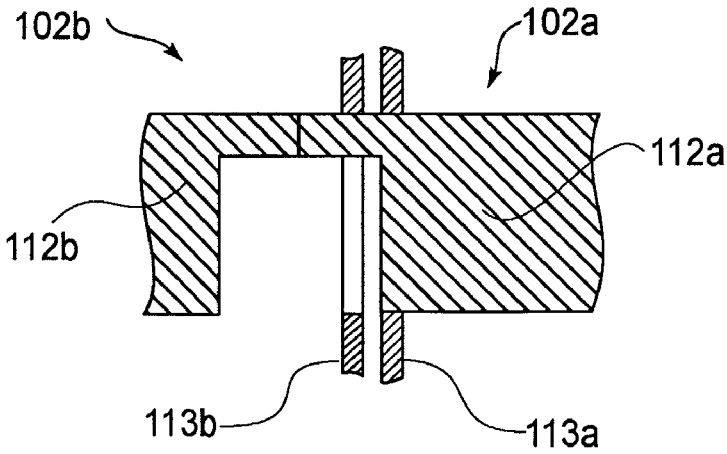

FIGS. 3(*a*) and 3(*b*) are schematic drawings showing the displacement of the slidable members of the adjacent two ink containers in an ink jet recording apparatus, which occurs when the two ink containers match in ink properties and are in their correct slots preset based on the color of the ink therein. The two drawings show only the slidable member 112*a* of the ink container 102 and the slidable member 112*b* of the ink container 102*b*. However, the relationship between the slidable member 112 of any ink container 102 and the slidable member 112 of the immediately adjacent ink container 112 is the same as that shown in FIG. 3.

In FIG. 3, the slidable member 112*a* can be placed in contact with the slidable member 112*b*. That is, as the slidable member 112*a* is pushed leftward (in drawing) when it is in the position shown in FIG. 3(*a*), the slidable member 112*a* protrudes from the opening of the side wall 113*a* of the ink container 102*a*, and comes into contact with the slidable member 112*b*. Then, the slidable member 112*a* invades into the slidable member slot of the ink container 102*b* through the opening of the side wall 113*b* while causing the slidable member 112*b* to protrude from the other side of the ink container 102*b*. The above described slidable member displacement which occurs in the ink container 102*a* and 102*b*, respectively, also occurs in the ink containers 102*c* and 102*d*, only when the ink containers 102*b* and 102*c* match in ink properties and are in their correct slots preset based on the color of the ink therein, and the ink containers 102*c* and 102*d* match in ink properties and are in their correct slots. That is, when the adjacent two ink containers 102 do not match in terms of the above described ink properties and are not in their correct slots, it does not occur that the slidable member of an upstream ink container, in terms of the direction in which the slidable member is pushed, protrudes downstream and pushes the slidable member of the immediately downstream ink container. Next, what occur and do not occur when the adjacent two ink containers 102 do not match in ink properties and/or are not in their preset slots will be described.

Figure 4:
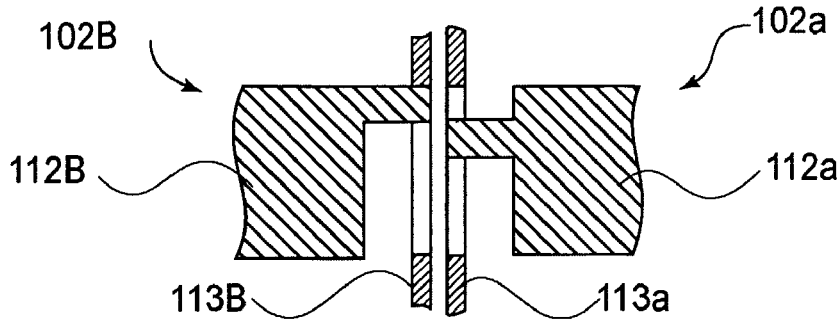
FIG. 4(*a*) is a schematic drawing of the displaceable members of the adjacent two ink containers, in the first embodiment, which are incorrectly arranged in the recording apparatus in terms of the order based on color, and/or do not match in the properties of the ink therein, before the displaceable members are displaced, and FIG. 4(*b*) is a schematic drawing of the same displaceable members as those in FIG. 4(*a*), after the displaceable member of the upstream ink container was displaced.
Figure 4:
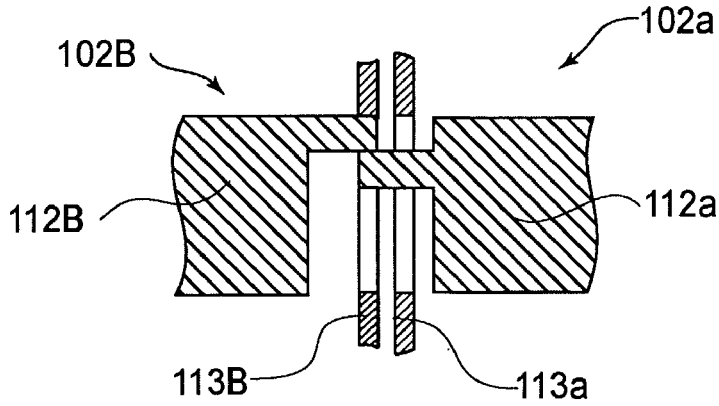

FIGS. 4(*a*) and 4(*b*) are schematic drawings showing the displacement and non-displacement of the slidable members of the adjacent two ink containers in an ink jet recording apparatus, which occurs when the two ink containers do not match in ink properties and are not in their correct slots preset based on the color of the ink therein. The two drawings show only the ink container 102*a*, and a slidable member 112*b*' which does not match the ink container 102*a* in terms of ink properties. However, the relationship between any of the rest of the ink containers 102 and the immediately adjacent ink container 112 is the same as that shown in FIG. 4.

In the case of the two ink containers 102*a* and 102*b*' shown in FIGS. 4(*a*) and 4(*b*), the lengthwise end of the slidable member 112*a* does not contact the lengthwise end of the slidable member 112*b*'. That is, as the slidable member 112*a* is pushed leftward (in drawing) when it is in the position shown in FIG. 4(*a*), the slidable member 112*a* protrudes from the opening of the side wall 113*a* of the ink container 102*a*, and invades into the opening of the lateral wall 113B of the ink container 102B. However, the lengthwise ends of the slidable members 112*a* and 112B are not in alignment with each other. Therefore, the slidable member 112*a* does not come into contact with the slidable member 112B, and therefore, does not push the 112B. Thus, if this relationship is present in any of the combinations of the adjacent two ink containers 102 (slidable members 112), the force applied to the upstream end of the slidable member 112*a* of the ink container 102*a* fails to be transmitted to the slidable member 112*d* of the ink container 102*d*, and therefore, the slidable member 112*d* of the ink container 102*d* does not protrude from the side wall of the ink container 102*d*.

Corresponding to the above described ink container structure, a lateral wall 601, which is one of the lateral walls of the ink container bay of the recording apparatus (FIG. 2), may be provided with a means for pushing the slidable member 112*a* of the ink container 102*a*, which is placed next to the lateral wall 601. The slidable member pushing means may be designed so that it protrudes only when a user makes it protrudes. For example, the slidable member pushing means may be made up of a pressing member and a pressure applying member. The surface of the pressing member, which comes into contact with the slidable member 112*a*, is shaped like a cam surface, so that as the ink containers are mounted, the pressing member is allowed to retract while compressing the pressure applying member. Any case, all that is necessary is that the pushing member is enabled to protrude, while causing the slidable member 112*a* to retreat, as soon as all ink containers are correctly mounted.

A lateral wall 602 (FIG. 2), which is the other lateral wall of the ink container bay of the recording apparatus, may be provided with a recess for accommodating the slidable member 112*d* of the ink container 102*d*, which faces the lateral wall 602. This recess is provided with a sensor for detecting the presence or absence of the slidable member 112*d* in the recess. It is only when all the ink containers in the ink container bay match in ink properties and are in their correct slots in the ink container bay that the intrusion of the slidable member 112*d* into the recess is detected by this sensor in the recess. Thus, when the intrusion of the slidable member 112*d* into the recess is detected by this sensor in the recess, the recording apparatus is enabled to carry out the normal operation, such as a recording operation. Further, when the slidable member 112*d* is in this condition, the pressing means on the recording apparatus side is in the slidable member slot of the ink container 102*a*, and the end portions of the slidable members 112*a* - 112*c* are in the slidable member slots of the ink containers 102*b* -102*d*, respectively. Further, the end portion of the slidable member 112*d* of the ink container 102*d* is in the recess on the recording apparatus side. Therefore, all the ink containers 102 are solidly anchored to the recording apparatus, preventing thereby a user from carelessly removing any of the ink containers 102.

The recess may be provided with a means for pushing the slidable member 112*d* of the ink container 102*d* back into the ink container 102*d*. As this means for pushing back the slidable member 112*d*, a member which can be operated by a user to push back the slidable members 112*d* - 112*a* may be employed, or a solenoid, which is connected to a rod and functions as it is supplied with electric current, may be employed so that all the slidable members 112 are pushed back by the rod. Anyway, as the slidable member 112*d* of the ink container 102*d* is pushed back by this pushing means, all the slidable members 112 are pushed back into their initial positions, allowing each ink container 102 to be individually removed.

Next, a preferable example of an ink jet recording apparatus which is compatible with the above described ink container structure will be described with regard to the structure of its control system and the control sequence.

Figure 5:
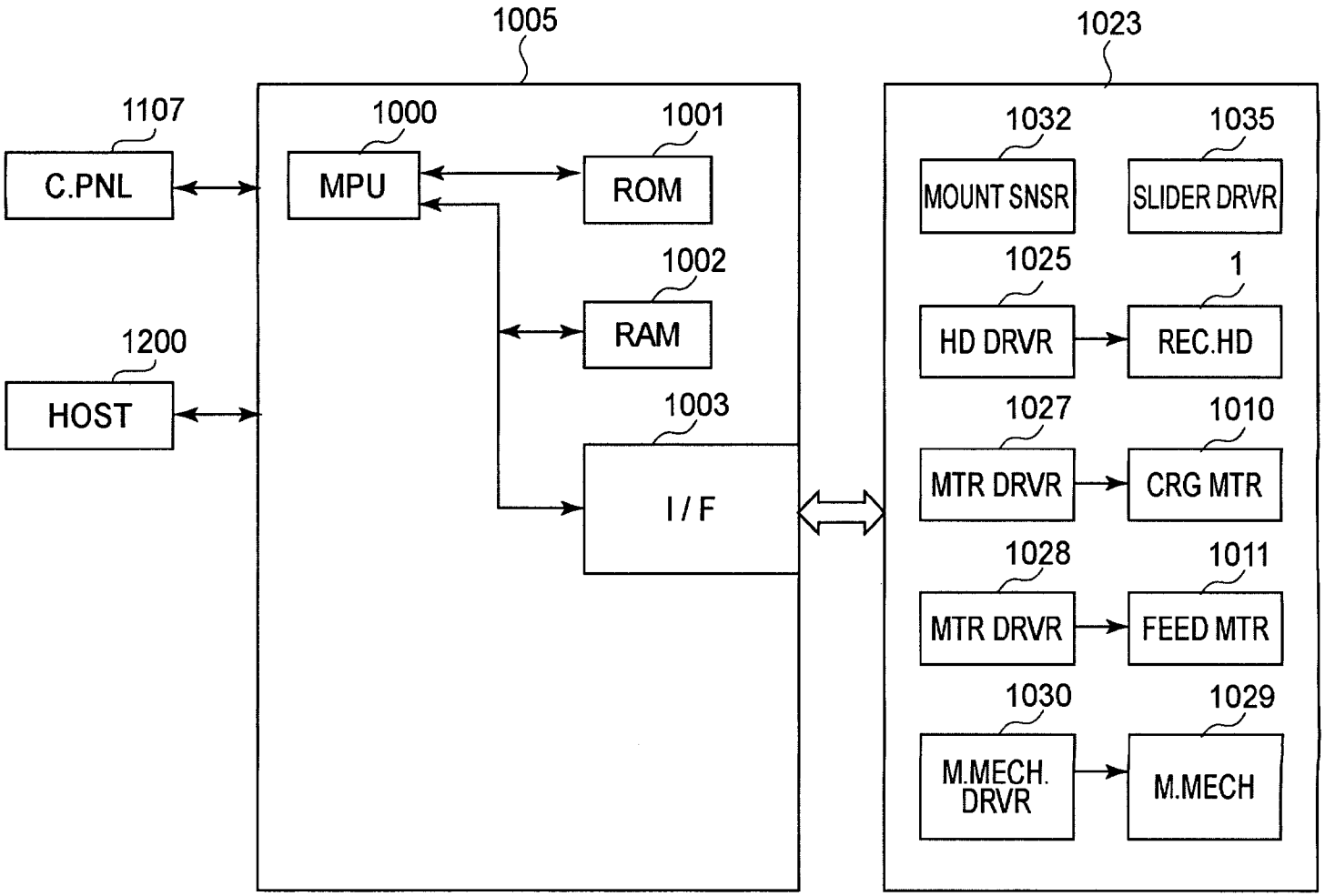
FIG. 5 is a block diagram of an example of the structure of the control system of an ink jet recording apparatus in the first embodiment.

FIG. 5 is a block diagram of an example of the configuration of the control system of the ink jet recording apparatus. Designated in FIG. 5 by a referential numeral 1005 is a control portion of the ink jet recording apparatus. The control portion 1005 is provided with an MPU 1000, which controls various sections of the apparatus when the control sequence, which will be described later, is carried out. Designated by a referential numeral 1001 is a ROM which stores the programs, fixed data, etc., related to the control sequence. The control portion 1005 is also provided with a RAM 1002, etc., which are used as work areas by the MPU 1000 when the control sequence is carried out.

To the control portion 1005, a control panel 1107 is connected. The control panel 1107 is provided with switches used by a user to operate the recording apparatus, a monitor for presenting information to the user, etc. Also connected to the control portion 1005 are a host apparatus 1200, such as a computer or a digital camera. The control portion 1005 is enabled to receive a recording start signal (command), and recording information signals inclusive of recording data, from the host apparatus 1200. Further, the control portion 1005 can send, as necessary, the status information on the recording apparatus side to the host apparatus 1200.

Further, a recording mechanism portion 1023 is connected to the control portion 1005, with an interface 1003 placed between the portions 1023 and 1005. The portion of the recording mechanism portion 1023, which is designated by a referential numeral 1005, is a head driver for driving a recording head 1 having multiple ink jetting portions for multiple inks, one for one, different in color. Designated by a referential numeral 1010 is a carriage motor, which is a driving force source for moving (in primary scan direction) a carriage on which the recording heads are mounted. Designated by a referential numeral 1027 is a motor driver for driving the carriage motor 1010. Designated by a referential numeral 1011 is a conveyer motor, which is a driving force source for conveying (in secondary scan direction) recording medium. Designated by a referential numeral 1028 is a motor driver for driving the conveyer motor 1011. Designated by a referential numeral 1029 is an ink jet head performance restoration unit, with which the recording apparatus is provided to maintain or restore the ink jetting performance of the recording head. The performance restoration unit 1029 includes: a cap for capping the surface (ink jetting surface) of the recording head, which has the ink jetting openings; a pump for generating negative pressure to suctioning out ink through the ink jetting openings, with the ink jetting surface capped with the cap; a blade for wiping the ink jetting surface; etc. Designated by a referential numeral 1032 is a sensor for detecting the presence or absence of the slidable member 112*d* in the recess. Further, designated by a referential numeral 1035 is a slidable member driving portion, which can be activated to push back the slidable member 112*d*.

Figure 6:
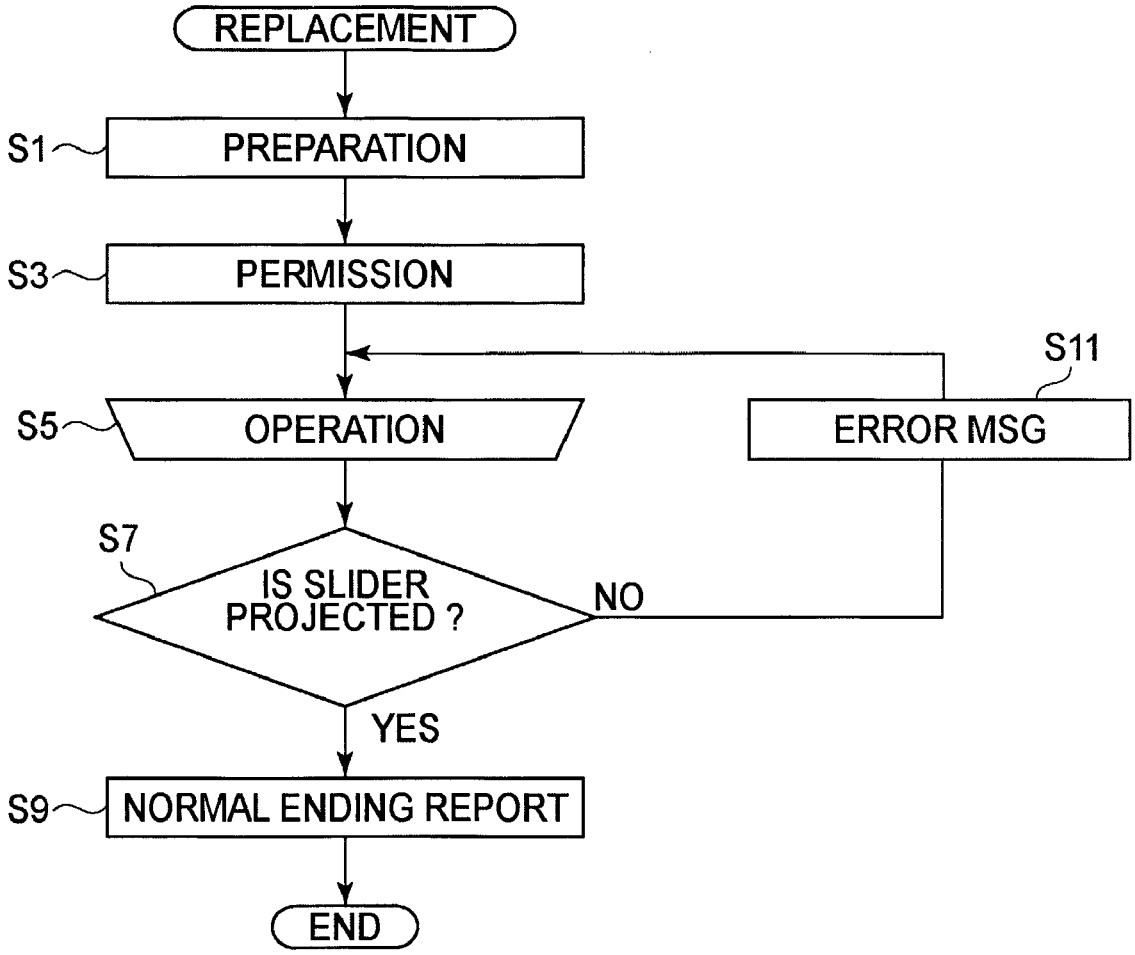
FIG. 6 is a flowchart of an example of an operation for replacing the ink containers in the ink jet recording apparatus, in the first embodiment.

FIG. 6 is a flowchart of an example of the procedural sequence, in the first embodiment, for replacing the ink containers in the recording apparatus. This procedure is carried out as the amount of the ink remaining in an ink container becomes extremely small, an ink container is virtually depleted of ink, a user wants the set of ink containers in the recording apparatus to be replaced with another set of ink container which are different in properties from the one in the recording apparatus, or in the like situation. In other words, this procedure is started, automatically or by a user, as the ink remainder amount detecting means of the recording apparatus indicates that one or more of the ink containers in the ink jet recording apparatus need to be replaced, or a user wants to replace one or more of the ink containers in the recording apparatus.

As this procedure is started, the preparatory process for ink container replacement is carried out in Step S1. As examples of this preparatory process, there are process for determining whether the apparatus is carrying out a recording operation or a performance restoration operation, process for putting the apparatus on standby at the end of the on-going operation, process for properly ending the on-going operation to put the apparatus on standby, etc.

In the case of an ink jet recording apparatus of the "off-carriage type", if an ink container is removed while ink is jetted from the ink container to record an image; ink is preparatorily jetted from the ink container; or ink is suctioned out of the recording head for restoring the recording head performance, problems occur. That is, during these operations, ink is flowing from the ink containers to the recording head. Therefore, if any of the ink containers is removed, air flows into the ink line through the opening created by the removal of the ink container, and enters the recording head while forming air bubbles. As air bubbles enter the recording head, they prevent ink from being jetted, making it impossible for the recording apparatus to form an image. In extreme cases, it is possible that the recording head will be damaged by the bubbles. Therefore, carrying out the abovementioned preparatory procedure before allowing a user to replace the ink container(s) is effective to prevent problems, such as the above described ones.

Next, the step for informing a user that the recording apparatus has be readied for the user to replace the ink container(s) is carried out (Step S3). As for the means for informing a user, it is possible to use the monitor with which the control panel 1107 of the recording apparatus is provided, the display with which the host apparatus 1200 is provided, or the like. Further, if the recording apparatus is provided with the slidable member driving portion 1035, a subordinate step for driving this portion 1035 to return the slidable members to their initial positions may be included in the preparatory step.

As the slidable members are returned to their initial positions, the ink containers become independent from each other, allowing a user to carry out an intended operation for replacing some of the ink containers, or the entirety of the set of ink containers, in the recording apparatus (Step S5). If all the ink containers in the recording apparatus match in ink properties, are in their correct slots arranged in the order preset based on color, after the ink container replacement, the slidable members 112*a* - 112*d* are displaced as described above. More specifically, referring to FIG. 2, the downstream end portions of the slidable members 112*a* - 112*c* are slid into the slidable member slots of their adjacent downstream ink containers, respectively, and the downstream end portion of the slidable member 112*d*, or the most downstream slidable member, is slid into the recess. This sliding movement of the downstream end portion of the slidable member 112*d* is detected by a sensor 1132 for detecting the slidable member 112*d* (Step S7). Then, the information that the ink container replacement operation has been successfully completed is conveyed to the user (Step S9), and this ink container replacement operation is ended.

On the other hand, if one or more of the ink containers in the recording apparatus are replaced with ink containers which do not match, in ink properties, the ink containers in the recording apparatus, or the replacement ink containers are mounted in the wrong spots in the ink container bay in terms of color, the slidable members 112*a* - 112*d* are not slid as described above; the force applied to the slidable member 112*a*, or the most upstream slidable member, is not transmitted to the slidable member 112*d*, or the most downstream slidable member while causing the slidable members to protrude and push the slidable members of the immediately downstream ink containers, respectively. Therefore, the downstream end portion of the slidable member 112*d* does not enters the recess with which the recording apparatus is provided, and therefore, is not detected by the sensor 1132 (Step S7). In this case, an error message, for example, is conveyed to the user (Step S11), and the recording apparatus waits for the user to correctly replace the wrong ink container(s) in the recording apparatus in Step S5.

Incidentally, as soon as the wrong ink container(s) is replaced with the correct one(s), the recording apparatus becomes ready for any of its normal operations, such as the actual recording operation. At the end of a successful ink container replacement operation, all ink containers in the recording apparatus will have been solidly anchored to the recording apparatus, being thereby prevented from being carelessly removed by the user. Therefore, it is possible to reliably prevent the problems, such recording errors or damage to the recording head. Thus, whether or not the ink containers in the recording apparatus match in ink properties, or are correct in terms of the order in the ink container bay, does not need to be continuously examined as long as the recording apparatus is normally operating. However, in order to ensure that the actual recording operation or the performance restoration operation are carried out only after it is confirmed that all the ink containers in the recording apparatus match in ink properties and are correct in order, whether or not the downstream end portion of the slidable member 112*d* is in the abovementioned recess may be checked even when the recording apparatus is normally operating.

Modified Versions of First Embodiment

The structural design, in accordance with the present invention, for checking whether or not the movement of the most upstream slidable member is transmitted to the most downstream slidable member, in order to determine whether or not the ink containers in a recording apparatus match in ink properties and are correct in order does not need to be limited to the one in the above described first embodiment. That is, it can be embodied in various forms in addition to the one in the first embodiment.

In the first embodiment, the slidable member of each ink container is shaped and sized so that when multiple ink containers are in an ink jet recording apparatus, the lengthwise end of the slidable member of one of the ink containers comes into contact with the corresponding lengthwise end of the slidable member of the immediately adjacent ink container, as force is applied to the former as described above, only when the two ink container match in ink properties and are correct in terms of the order in which the ink containers are arranged based on color. Instead, however, the slidable member of an ink container, and the lateral wall of the ink container, which is perpendicular to the slidable member, may shaped and sized to achieve the abovementioned effects.

Figure 7:
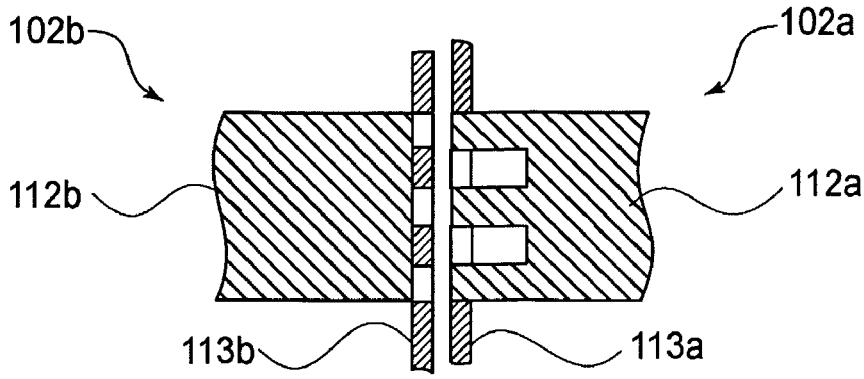
FIG. 7(*a*) is a schematic drawing of the displaceable members of the adjacent two ink containers, in one of the modified version of the first embodiment, which are correctly arranged in the recording apparatus in terms of the order based on color, and match in the properties of the ink therein, before the displaceable members are displaced, and FIG. 7(*b*) is a schematic drawing of the same displaceable members as those in FIG. 7(*a*), after they were displaced.
Figure 7:
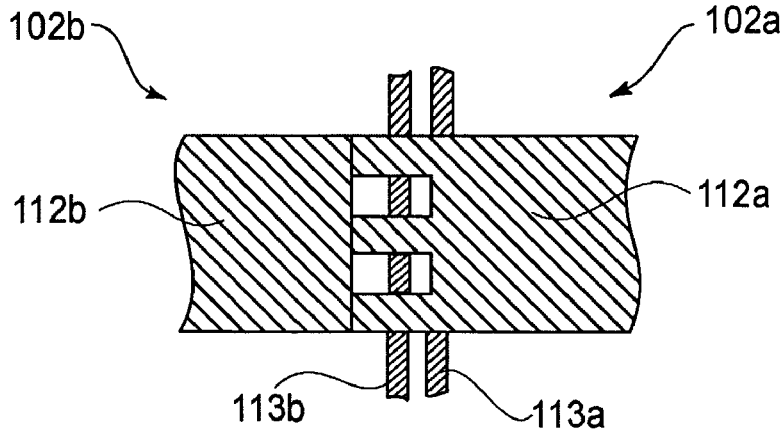

FIGS. 7(*a*) and 7(*b*) are schematic drawing showing the sliding of the slidable members, in one of the modified versions of the first embodiment, of the adjoining two ink containers in the ink jet recording apparatus, which match in ink properties and are correct in terms of the order in which they are to be arranged based on the color of the ink therein. FIG. 7 shows only the slidable member 112*a* of the ink container 102*a* and the slidable member 112*b* of the ink container 102*b*. However, the relationship between the adjoining two among the other ink containers is the same as the relationship between the slidable members 112*a* and 119*b* of the ink containers 102*a* and 102*b*, respectively.

In the case of this modification, the downstream end portion of the slidable member 112*a* is provided with teeth (three in this case) like those of a comb, whereas a lateral wall 113*b* of the ink container 102*b* is provided with holes, which correspond in number and location to the teeth of the slidable member 112*a*, so that the slidable member 112*a* is allowed to come into contact with the slidable member 112*b* through the holes. That is, as the slidable member 112*a* in the position shown in FIG. 7(*a*) is pushed in the leftward (in drawing), the downstream end portion of the slidable member 112*a* protrudes from the opening of the lateral wall 113*a* of the ink container 102*a*, and enters the ink container 112*b* through the abovementioned holes of the lateral wall 113*b* of the ink container 102*b*, pushing thereby the slidable members 112*b* of the ink container 102*b*. As a result, the slidable member 112*b* is displaced leftward. This sequential sliding of the slidable members 112*a* and 112*b* are possible only when the two ink containers 102*a* and 102*b* match in ink properties and are correct in order. If the two ink containers 102*a* and 102*b* do not match in ink properties and are not in order, the above described sequential sliding of the slidable members 112*a* and 112*b* do not occur. This is also true with the adjacent two among the ink containers other than the ink containers 102*a* and 102*b*.

Figure 8:
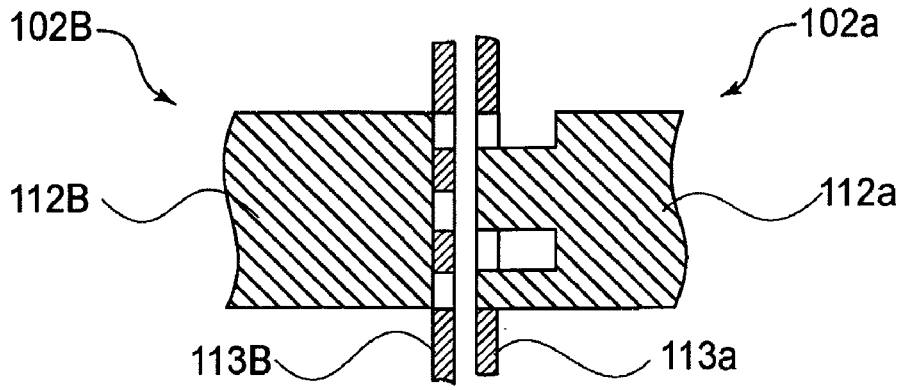
FIG. 8(*a*) is a schematic drawing of the displaceable members of the adjacent two ink containers, in the same modified version of the first embodiment as the abovementioned one, which are incorrectly arranged in the recording apparatus in terms of the order based on color, and/or do not match in the properties of the ink therein, before the displaceable members are displaced, and FIG. 8(*b*) is a schematic drawing of the same displaceable members as those in FIG. 8(*a*), after the displaceable member of the upstream ink container was displaced.
Figure 8:
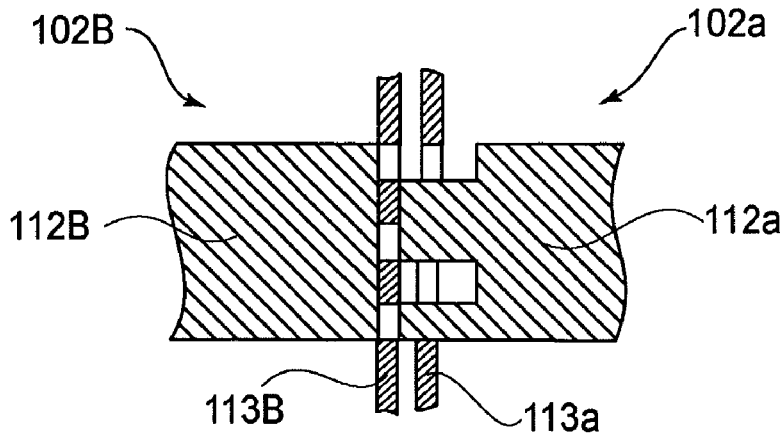

FIGS. 8(*a*) and 8(*b*) are schematic drawing showing the behavior of the slidable members, in the same modified version of the first embodiment, of the adjoining two ink containers in the ink jet recording apparatus, which do not match in ink properties and/or are incorrect in terms of the order in which they are to be arranged based on the color of the ink therein. FIG. 8 shows only the slidable member 112*a* of the ink container 102*a*, and the slidable member 112*b*' of the ink container 102*b*' which does not match the ink container 102*a*. However, the relationship between the adjoining two among the other ink containers is the same as the relationship between the slidable members 112*a* and 112*b*' of the ink containers 102*a* and 102*b*', respectively. FIG. 8 is a schematic drawing showing the adjacent two ink container in the recording apparatus, and their slidable members, in the modified version of the first embodiment, which do not match in ink properties and are not correct in order. FIG. 8(*a*) and FIG. 8(*b*) show the interfacial portions of the two ink containers in the recording apparatus, and their slidable member, before the application of force to the upstream end of the slidable member 112*a*, and after the slidable member 112*a* was moved by the force, respectively. Shown in FIG. 8 are the slidable member 112*a* of the ink container 102*a*, and the slidable member 112*b*' of the ink container 102*b* which does not match the ink container 102 in ink properties. However, the relationship between the two slidable members of the adjacent two ink containers 102 other than the ink containers 102*a* and 102*b* is the same as the one shown in FIG. 8.

In this case, the lateral wall 113A of the ink container 102B is not provided with holes which match the teeth-like protrusions of the slidable member 112*a* in shape, size, and/or position, and therefore, it does not allow the slidable member 112*a* to enter the slidable member slot of the ink container 102*b*'. Therefore, as the slidable member 112*a* is pushed leftward when it is in the position shown in FIG. 8(*b*), the slidable member 112*a* collides with the lateral wall 113*a* of the ink container 102*b*, being thereby prevented from entering the slidable member slot of the ink container 102*b*'. Therefore, the slidable member 112*a* does not come into contact with the slidable member 112*b*, failing therefore to displace the slidable member 112*b*'. As long as this relationship is present in one of the combinations of adjacent two ink containers in the recording apparatus, the sliding movement fails to be transmitted to the most downstream slidable member, that is, the slidable member 112*d*, and therefore, the downstream end portion of the slidable member 112*d* does not protrude from the lateral wall of the ink container 102*d*.

As described above, the structural arrangement in this modified version of the first embodiment can also achieve the objects of the present invention, and is just as effective as that in the first embodiment.

Incidentally, the first embodiment described above can be modified to use the sliding of the slidable member to more directly and clearly indicate whether or not the ink container replacement is possible.

Figure 9:
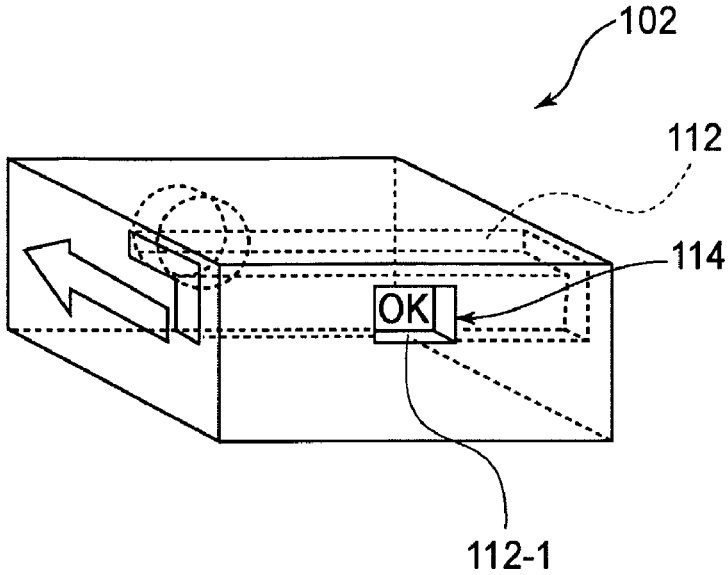
FIGS. 9(*a*) and 9(*b*) are perspective phantom views of the ink container in another modified version of the first embodiment, showing the structure and operation thereof.
Figure 9:
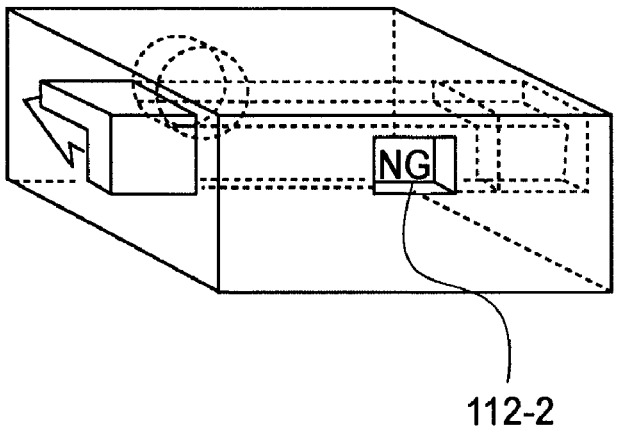

FIGS. 9(*a*) and 9(*b*) are perspective phantom views of the ink container in another modified version of the first embodiment, showing the structure and operation thereof. The slidable member 112 is provided with inscriptions 112-1 and 112-2, which indicate that the ink containers in the recording apparatus may, or may not, be replaced, respectively. On the other hand, the front wall (which faces operator) of the ink container 102 is provided with a window 114, through which the inscription 112-1 or 112-2 can be seen. The position of the slidable member 112 relative to the corresponding ink container 102 changes according to whether or not the ink container 102 is correct in terms of ink properties and positional order when the ink container 102 is in a recording apparatus. Therefore, it is possible for a user to see, through the window 114, whether a given ink container 102 in the recording apparatus is allowed to be replaced (FIG. 9(*a*)) or not (FIG. 9(*b*). That is, the provision of these inscriptions makes it possible to warn a user that the ink container replacement is not allowed, or to inform a user that the ink container replacement is allowed.

Further, this type of inscription can be used for conveying the information regarding whether or not ink container replacement has been correctly performed. That is, a structural arrangement may be made so that if the ink container replacement is correctly carried out, an inscription indicating that the ink container replacement was correctly carried out is displayed, whereas if the ink container replacement is incorrectly carried out, an inscription indicating that the ink container replacement is incorrectly carried out is displayed. Moreover, it is possible to modify the structural arrangement so that both the inscription indicating that ink containers is allowed to be replaced, and the inscriptions indicating whether or not the ink container replacement has been correctly carried out, can be displayed at the same time.

Further, in the first embodiment, both the object of allowing only replacement ink containers, which match, in properties, the ink containers in the recording apparatus, to be mounted to replace the ink containers in the recording apparatus, and the object of ensuring that ink containers are correct in terms of the order in which they are to be arranged based on the color of the ink therein, are realized by providing the slidable member of each ink container with a shape specific to a certain ink property (or properties). However, the structural arrangement in the first embodiment may be modified so that the two objects are individually achieved.

Figure 10:
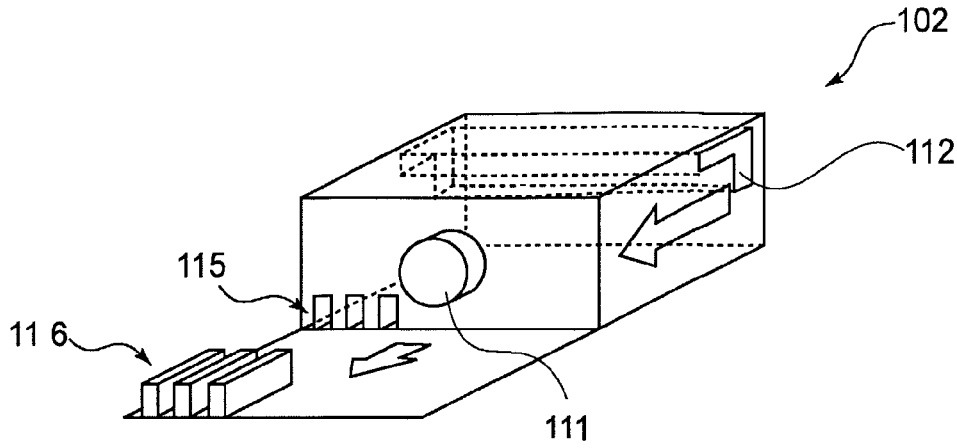
FIG. 10 is a perspective view of the ink container in yet another modified version of the first embodiment, showing the structure and operation thereof.

FIG. 10 shows an example of such a modified version of the first embodiment. In this modified version of the first embodiment, in order to ensure that multiple ink containers different in the color of the ink therein are correctly arranged in terms of the order in which they are to be arrange based on the color of the ink therein, the ink container 102 is provided with multiple (three in this modified version) slits 115 for preventing the ink container from being fitted in the wrong slot in the ink container bay, and the main assembly of the recording apparatus is provided with multiple (three in this modified version) ribs 116, which matches the slits on the ink container side, in shape, number, and size. Their positions, numbers, and sizes are set according to the color of the ink to which the ink containers are assigned. Therefore, if an attempt is made to mount an ink container into the incorrect ink container slot in the ink container bay, the ink container cannot be mounted. Therefore, not only is it possible to prevent two inks different in color from being mixed, but also, a user is directly informed of the insertion of the ink container into the wrong slot.

That is, in the case of this modified version of the first embodiment, the role of allowing only replacement ink containers, which match, in ink properties, the ink containers in the recording apparatus, to be mounted into the recording apparatus to replace the ink containers in the recording apparatus, and the role of ensuring that the replacement ink containers are correctly arranged in the ink container bay in terms of the order in which they are to be arranged based on the color of the ink therein, are separated, and the slidable members are used for the former role. Therefore, in this modified version of the first embodiment, the slidable members can be simplified in shape.

Embodiment 2

In the first embodiment, the structural arrangement for displacing the slidable members to solidly anchors the ink containers to the recording apparatus, or freeing them from the recording apparatus is employed. However, the structure for solidly anchoring the ink containers to the recording apparatus may be separately provided from the structure for freeing them from the recording apparatus.

Figure 11:
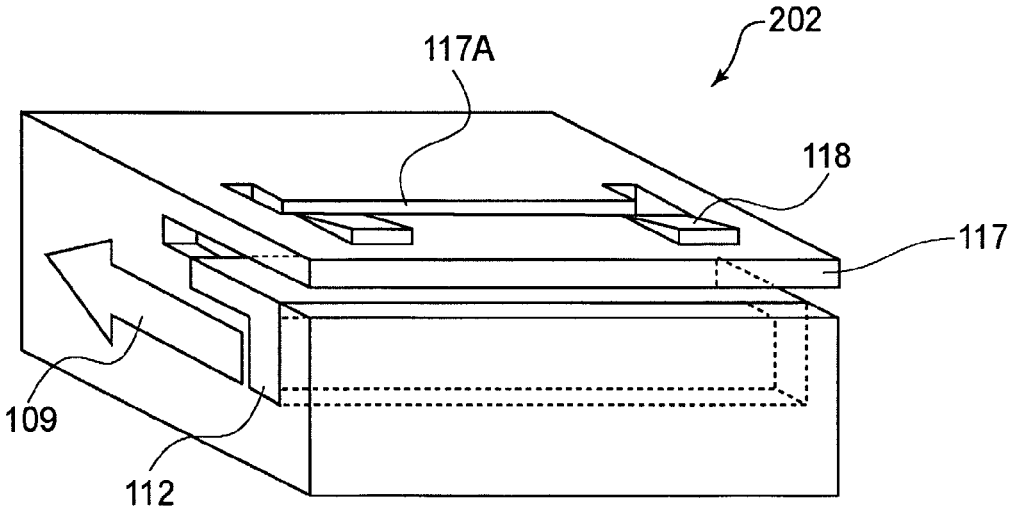
FIG. 11 is a perspective view of the ink container in the second embodiment of the present invention, as seen from the side from which a user mounts the ink container into the main assembly of an ink jet recording apparatus.

FIG. 11 is a perspective view of the ink container in this embodiment, as seen from the side which faces a user when the user mount the ink container into the recording apparatus. Incidentally, the components, the sections thereof, etc., of the ink container in this embodiment, which are the same in function as those in the first embodiment, are given the same referential numerals as those of the ink container in the first embodiment.

An ink container 202 in this embodiment is provided with a latch lever 117 as a means for solidly anchoring the ink container 202 to the recording apparatus, or freeing it from the recording apparatus. The latch lever 117 is in the form of a cantilever. The ink container 202 is designed so that the free end portion of the latch lever 117 points toward the side from which a user handles the ink container 202. The latch lever 117 constitutes a part of the top portion of the ink container 202. Designated by a referential numeral 117A is a slit, with which the latch lever 117 is provided to adjust the modulus of elasticity of the latch lever 117 to make it possible for the latch lever 117 to be elastically deformed with the application of a moderate amount of force to the latch lever 117. Designated by a referential numeral 118 is a protrusion, which is located on the top surface of the latch lever 117 to keep the ink container 202 solidly anchored to the recording apparatus, by latching with the catch with which the ink container bay of the recording apparatus is provided.

Figure 12:
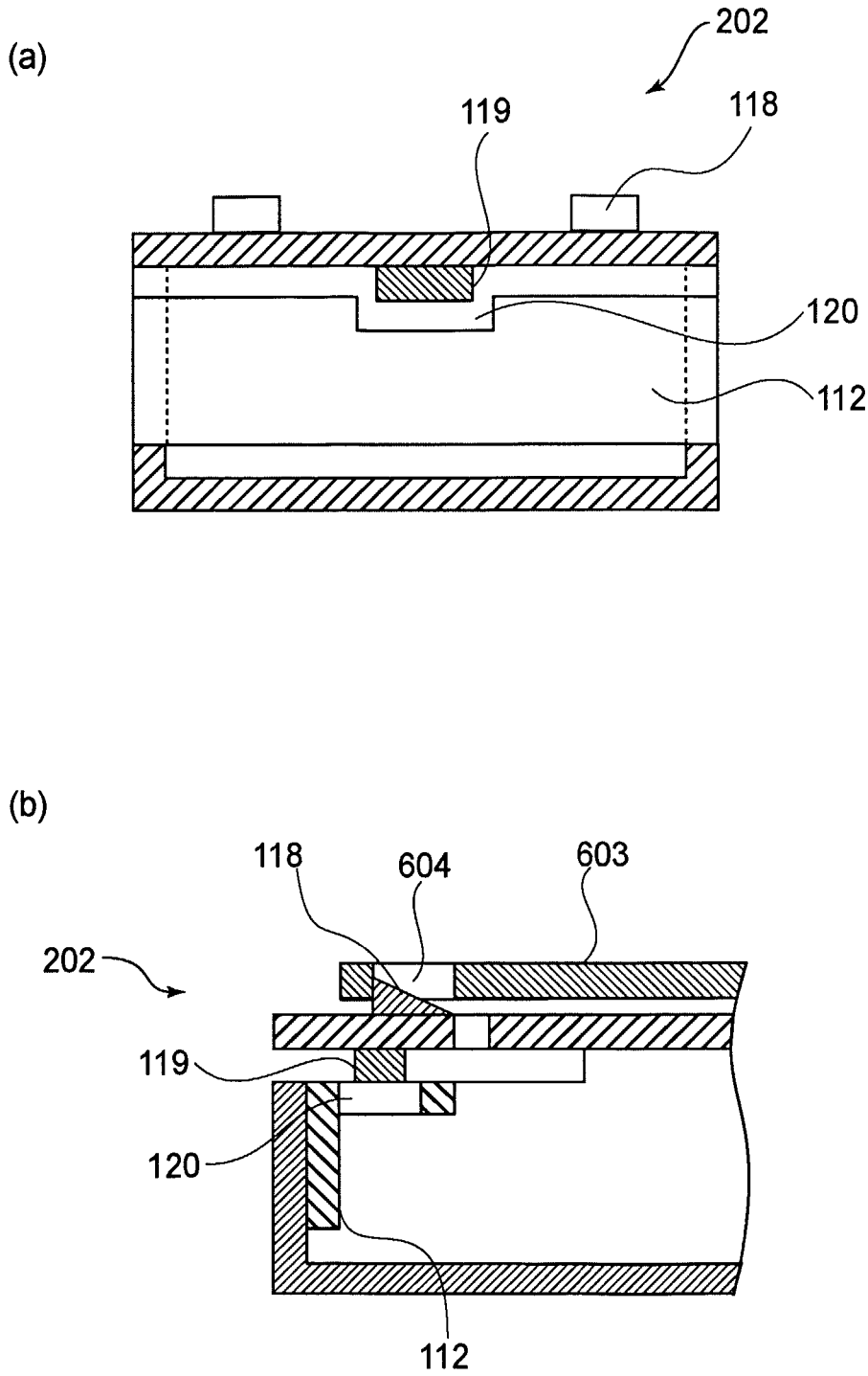
FIGS. 12(*a*) and 12(*b*) are sectional views of the ink container in the second embodiment, the slidable member of which is in the initial position.

FIG. 12(*a*) is a sectional view of the ink container 202, the slidable member of which is in its initial position, enabling thereby the ink container 202 to be replaced. Referring to this drawing, designated by a referential numeral 119 in this drawing is a protrusion located on the bottom surface of the latch lever 117, and designated by a referential numeral 120 is a recess with which the slidable member 112 is provided to prevent the latch lever 117 from interfering with the protrusion 119 when the latch lever 117 is elastically bent.

FIG. 12(*b*) is a cross-sectional view of the ink container 202, which is in the recording apparatus and is ready to be replaced (its slidable member 112 is in its initial position). When the ink container 202 is in the condition shown in FIG. 12(*b*), the protrusion 118 located on the top surface of the latch lever 117 is in a hole 604 with which the top wall 603 of the ink container bay of the main assembly of the recording apparatus is provided, whereas the protrusion 119 located on the bottom surface of the latch lever 117 is facing the recess 120 with which the slidable member 112 is provided.

Figure 13:
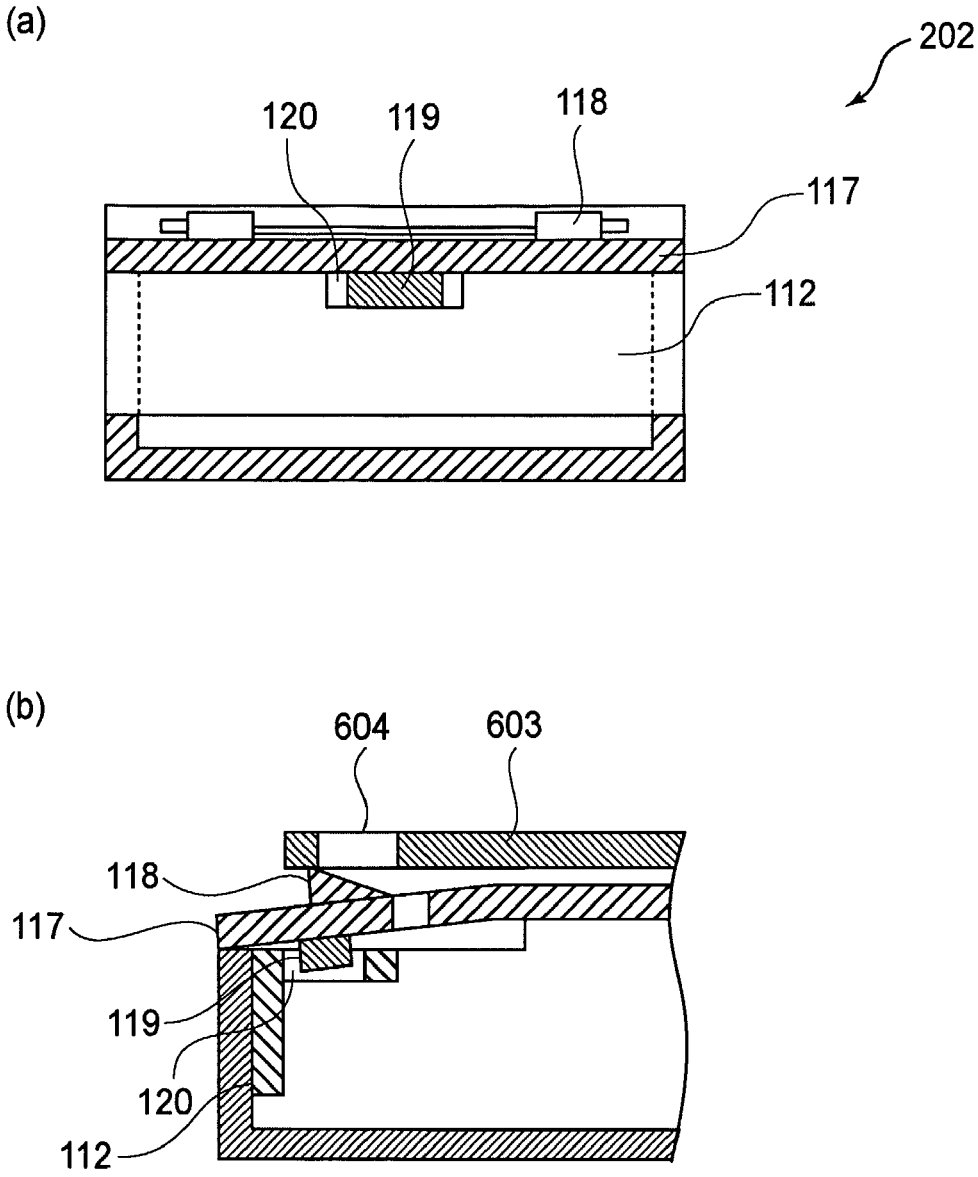
FIGS. 13(*a*) and 13(*b*) are sectional views of the ink container in the second embodiment, showing the operation for replacing the ink container in the recording apparatus.

FIG. 13(*a*) is a sectional view of the ink container 202, the slidable member of which is in its initial position, and the latch lever 117 of which has been elastically bent due to the depression of its protrusion 118 by the top wall 603 of the ink container bay, being therefore freed from the hole 604. FIG. 13(*b*) is a cross-sectional view of the same ink container as the one in FIG. 13(*a*), which is in the same condition as that shown in FIG. 13(*b*). When the ink container 202 is in this condition, the protrusion 118 is out of the hole 604, and the protrusion 119 is in the recess, without interfering with the slidable member 112. Therefore, the ink container 202 can be removed by a user.

The state of the ink container 202 shown in FIGS. 13(*a*) and 13(*b*) is the state of the ink container 202 into which the state of the ink container 202 shown in FIGS. 12(*a*) and 12(*b*) changes while the ink container 202 is mounted into the ink container bay of the recording apparatus. That is, as the process of mounting the ink container 202 into the ink container bay progresses, first, the slanted top surface of the protrusion 118 of the latch member 117 comes into contact with the top wall 603 of the ink container bay. As the process progresses further, the latch lever 117 is elastically bent by this contact between the slanted top surface of the protrusion 118 and the top wall 603, allowing thereby the ink container 202 to be mounted into the ink container bay. Incidentally, the elastic bending of the latch lever 117 is permitted by the presence of the recess 119, which accommodates the protrusion 119. Then, as the process of the mounting the ink container 202 progresses further, the protrusion 118 reaches the hole 604, and is pushed into the hole 604 by the resiliency of the latch lever 117, allowing the latch lever 117 to unbend. As a result, the state of the ink container 202 shown in FIG. 12(*b*) is restored.

The removal of the ink container is prevented by sliding the slidable member 122 out of its initial position.

Figure 14:
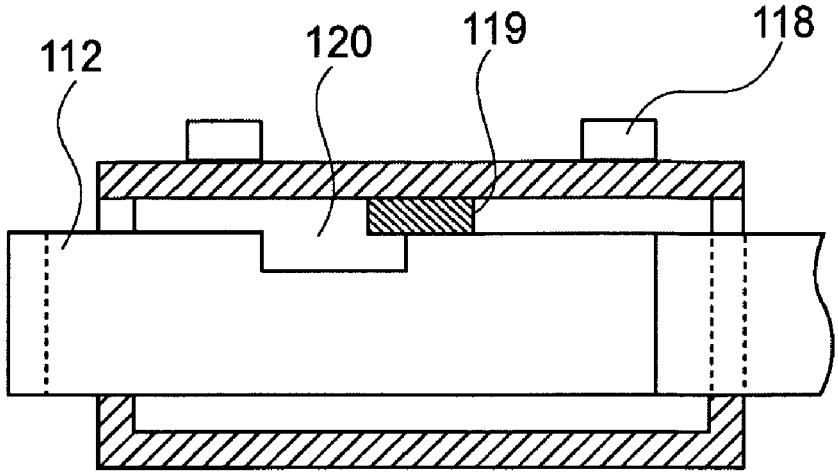
FIGS. 14(*a*) and 14(*b*) are sectional views of the ink container, in the second embodiment, which is in the state which prevents the ink container from being replaced.
Figure 14:
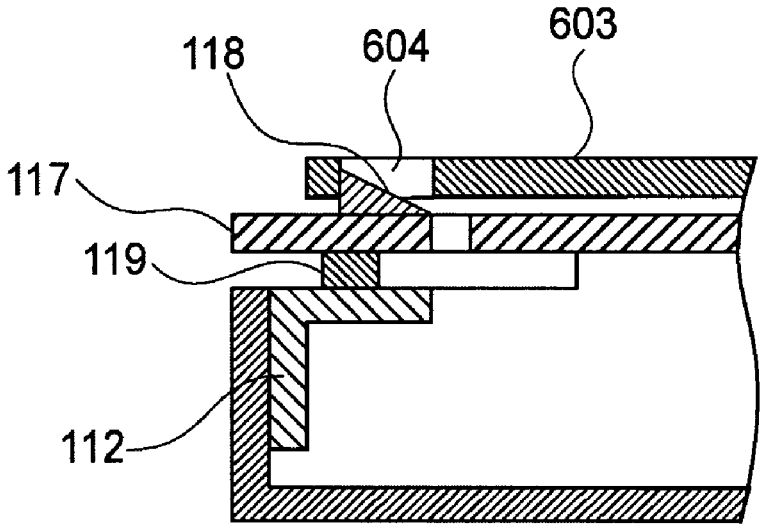

FIG. 14(*a*) is a sectional view of the ink container 202, which cannot be replaced because its slidable member is protruding. FIG. 14(*b*) is a cross-sectional view of the same ink container 202 as that shown in FIG. 14(*a*), which is in the same state as that shown in FIG. 14(*a*). When the ink container 202 is in this state, that is, after the displacement of the slidable member 112, the protrusion 119 and recess 120 do not squarely face each other. Thus, if an attempt is made to operate the latch lever 117, the protrusion 119 interferes with the slidable member 112, preventing the protrusion 118 from coming out of the hole 604. That is, it is impossible to remove the ink container, when the ink container is in the state shown in FIG. 14(*a*).

The same effects as those realized by the first embodiment can also be realized by this embodiment. Further, in this embodiment, the force which prevents the ink container from being removed is not caught by the slidable member alone. Therefore, this embodiment offers the effect of allowing the requirement concerning the strength of the slidable member, the requirement concerting the area of the ink container, in which the slidable member is fitted, and the like, to be eased.

Incidentally, as for the method for sliding the slidable member 112 from its initial position into the position in which it plays its role, and vice versa, the same method as that used in the first embodiment can be used. Further, this embodiment is also modifiable in the same manner as that in which the first embodiment is modifiable.

Embodiment 3

Next, another embodiment of the present invention will be described as the third embodiment of the present invention, in which the operation to be carried out by a user to replace the ink container in a recording apparatus is simpler than those in the preceding embodiments.

Figure 15:
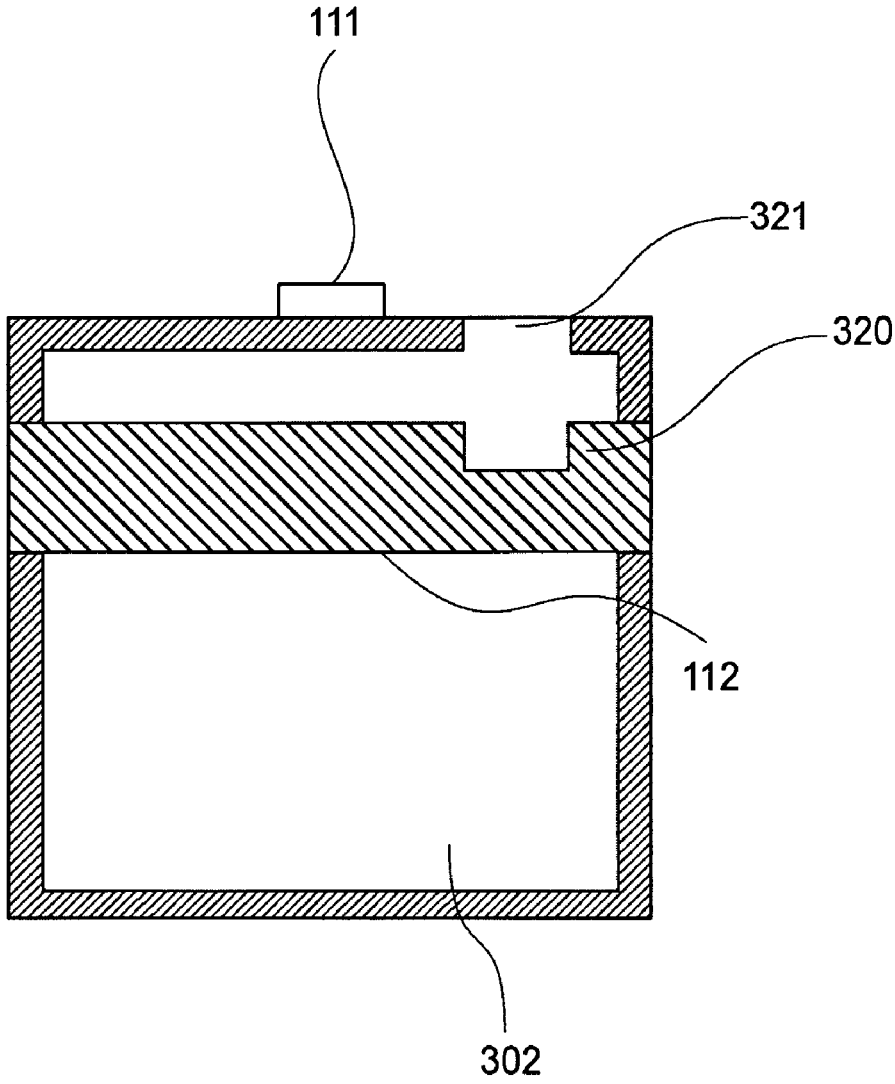
FIG. 15 is a cross-sectional view of the ink container in the third embodiment of the present invention.

FIG. 15 is a sectional view of the ink container in this embodiment, at a plane parallel to the top surface of the ink container. Incidentally, the components, the sections thereof, etc., of the ink container in this embodiment, which are the same in function as those in the first embodiment are given the same referential numerals as those in the first embodiment.

In this embodiment, the wall of the ink container 302, which is provided with a spout 111 as an ink outlet, is provided with a hole 321, whereas the slidable member 112 is provided with a recess 320, which squarely faces the opening of this hole 321 when the slidable member 112 is in the initial position.

Figure 16:
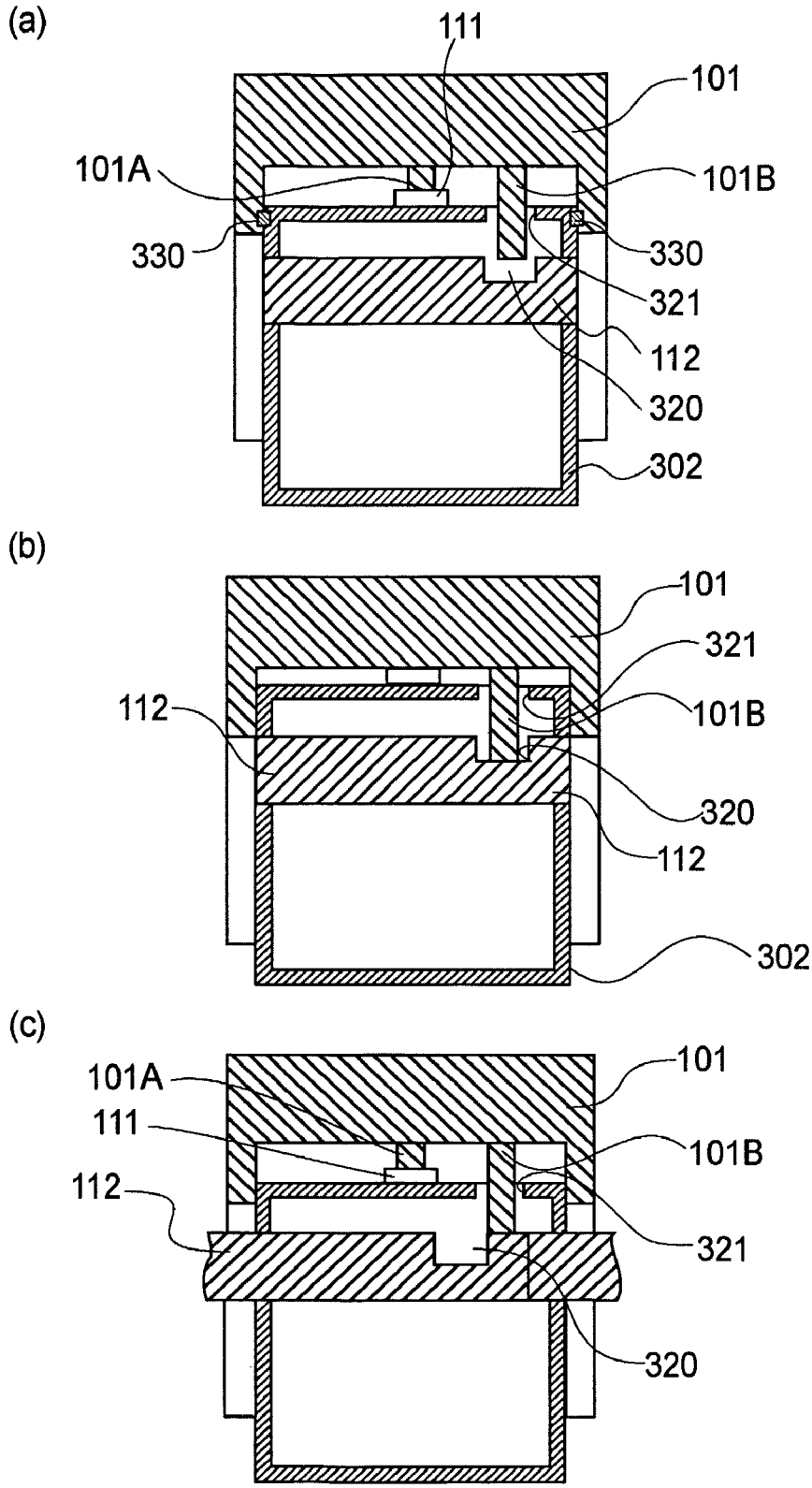
FIGS. 16(*a*)-16(*c*) are schematic drawings showing the three stages in which the ink container in the third embodiment will be while it is replaced.

FIG. 16(*a*) is a cross-sectional view of the ink container 302, which is in the recording apparatus and is ready to be replaced (slidable member of ink container 302 is in its initial position). The ink container bay 101 of the recording apparatus is provided with a spout 101A, as an ink inlet, connectible with the spout 111 of the ink container 302, and a protrusion 101B which is tall enough to be in the hole 321 when the ink container 302 is in the ink container bay 101. When the ink container 302 is in the state shown in FIG. 16(*a*), the spout 111 is in connection with the spout 101A, and the protrusion 101B is in the hole 321, squarely facing the recess 320.

The ink container bay 101 of the recording apparatus is provided with an alternately latching-and-unlatching mechanism 330 for improving the recording apparatus in terms of the efficiency with which an ink container can be mounted into the recording apparatus or removed therefrom, and the ink container 302 is provided with a portion (for example, protrusion), which works with the mechanism 330. The alternately latching-and-unlatching mechanism 330 is also called push-on-push-off mechanism, and is similar to the mechanism employed by an ordinary push button switch, which is devised so that as the button of the switch is pressed in the axial direction of the switch, it connects the electrical contacts, and keeps the electric contacts connected even after the pressure is removed from the button, whereas as the button is pressed next time, the electrical contacts are separated from each other and remain separated.

In order to provide the ink container bay with the mechanism similar to the above described mechanism employed by an ordinary push button switch, the technologies disclosed in Japanese Laid-open Patent Application 60-137660, for example, can be used. More concretely, according to this document, the ink container bay of the recording apparatus is provided with an alternately latching-and-unlatching catch rotatable in the direction parallel to the direction in which the ink container is mounted, and a spring for keeping the ink container in the ink container bay pressured in the direction to be moved out of the ink container bay. On the other hand, the ink container is provided a protrusion or the like, shaped and located so that when the ink container is mounted into the ink container bay or removed therefrom, it comes into contact with the catch of the ink container bay and rotates the catch. In order to mount the ink container into the ink container bay, a user is to push the ink container into the ink container as far as possible, and then, release the ink container. As the ink container is released, the ink container is push back by the abovementioned spring in the direction in which the ink container is to be pulled when the ink container needs to be removed. As the ink container is pushed back, the catch, which has been rotated by the protrusion or the like of the ink container while the ink container was inserted, catches the protrusion or the like, locking thereby the ink container in a preset position. When it is necessary to remove the ink container, the user is to push the ink container inward. As the ink container is pushed inward, the catch is rotated by the coordination of the pressure applied by the spring, being thereby disengaged from the ink container, and is locked in the position in which it does not catch the protrusion or the like of the ink container.

FIG. 16(*b*) is a cross-sectional view of the ink container 302, which a user has just pushed inward of the ink container bay as far as possible to mount or remove it (slidable member of ink container 302 is in its initial position). When the ink container 302 is in the state shown in FIG. 16(*b*), the protrusion 101B is in the recess 320, without interfering with the slidable member 112.

As the user stop pushing the ink container 302 while the ink container 302 is in this state, the ink container 302 is pushed outward by the resiliency of the spring with which the ink container bay 101 is provided. As the user releases the ink container 302 after pushing the ink container 302 as inward as possible to remove the ink container 302, the ink container 302 is pushed out by the resiliency of the spring, with no interference from the alternately latching-and-unlatching mechanism 330. On the other hand, as the user releases the ink container 302 after pushing the ink container 302 as inward as possible of the ink container bay 101 in order to mount the ink container 302, the outward movement of the ink container 302 is stopped by the alternately latching-and-unlatching mechanism 330, in the state shown in FIG. 16(*a*). It is in this state that the slidable member 112 is to be slid. As the slidable member 112 is slid, it becomes impossible for the ink container 302 to be removed.

FIG. 16(*c*) is a cross-sectional view of the ink container 302, which is in the recording apparatus, and the slidable member 112 of which is protruding, making it impossible for the ink container 302 from being removed from the recording apparatus. When the ink container 302 is in the state shown in FIG. 16(*c*), the slidable member 112 has been displaced, and therefore, the protrusion 101B is not squarely facing the recess 320. Therefore, even if an attempt is made to push the ink container 302 inward to remove the ink container 302, the protrusion 101B interferes with the slidable member 112, preventing thereby the ink container 302 from being moved inward. That is, the state of the ink container 302 shown in FIG. 16(*c*) is the state of ink container 302 in which ink container 302 cannot be removed.

This embodiment can offers the same effects as those offered by the first embodiment. In addition, this embodiment makes it possible for a user to replace the ink container with a single action, provided that the slidable member 112 is in the initial position. Therefore, this embodiment can offer an additional effect of improving the recording apparatus in operational efficiency.

Incidentally, as for the method for sliding the slidable member 112 from its initial position into the position in which it plays its role, and vise versa, the same method as that used in the first embodiment can be used. Further, it is obvious that this embodiment is also modifiable in the same manner as that in which the first embodiment is modifiable.

Embodiment 5

Up to this point, the embodiments in which four ink containers are juxtaposed in parallel and in a straight line, have been described. However, the present invention is also applicable to a recording apparatus in which ink containers are arranged with intervals.

Figure 17:
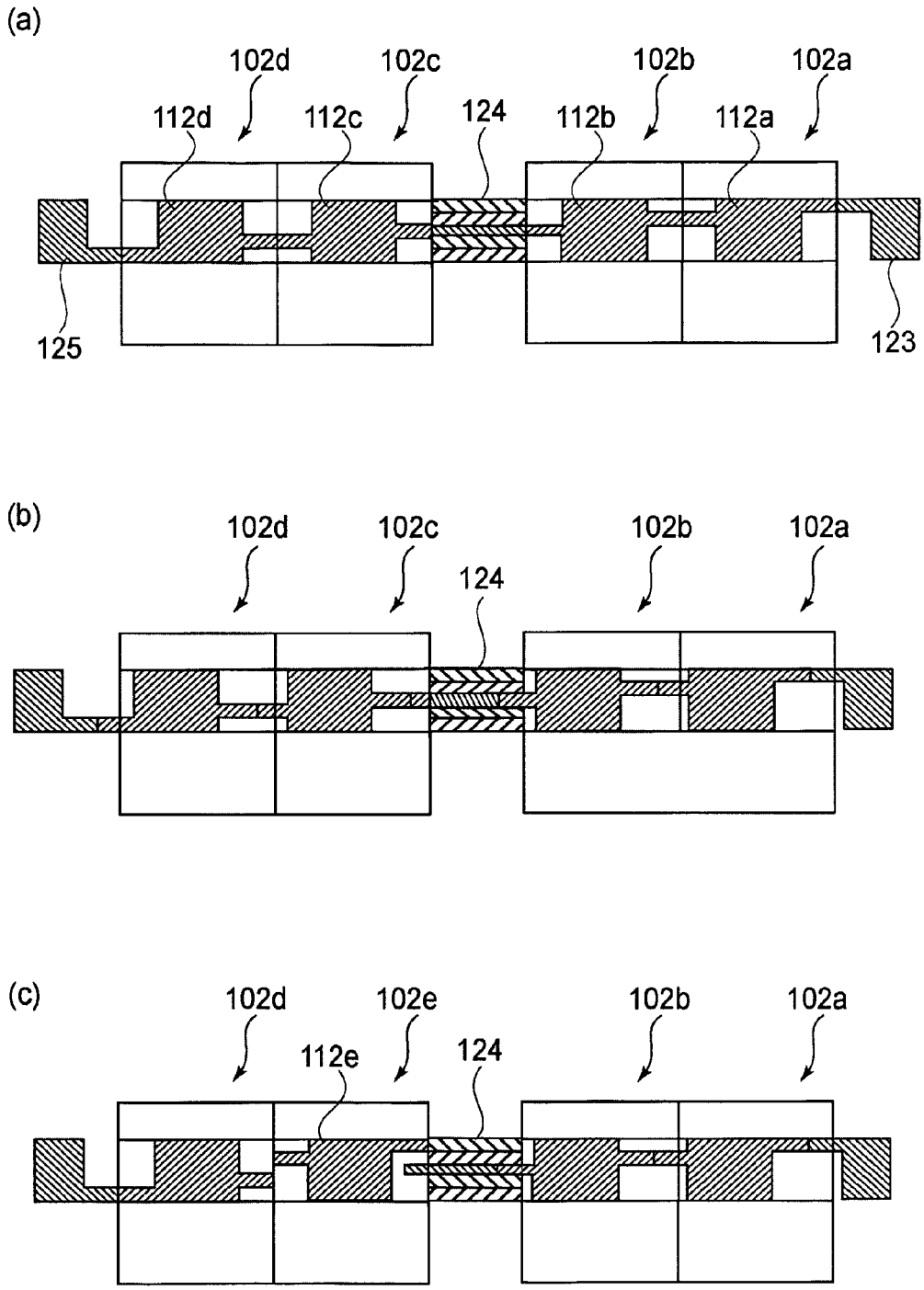
FIGS. 17(*a*)-17(*c*) are sectional views of the ink container in the fourth embodiment of the present invention, showing the structure and operation thereof.

FIGS. 17(*a*)-(*d*) show an example of a recording apparatus in which ink containers are arranged with intervals (one interval in this embodiment). More specifically, the ink containers of the recording apparatus shown in FIG. 17 are arranged in a straight line, and are grouped in two, being thereby separated into two groups of ink container, each of which has two ink containers. Two groups are disposed with the presence of a preset distance between the two groups. Incidentally, the components, the sections thereof, etc., of the ink container in this embodiment, which perform the same functions as those in the first embodiment are given the same referential numerals as those in the first embodiment.

Designated by a referential numeral 123 in the drawings is a pressing member, with which one of the lateral walls of the ink container bay of the recording apparatus is provided. The pressing member 123 is driven by the slidable member driving portion 1035. As the pressing member 123 is driven, it presses the slidable member 112*a* of the ink container 102*a*, that is, the slidable member located next to the pressing member 123. Designated by a referential numeral 125 is an ink container presence sensor for detecting whether or not the slidable member 112*d* of the ink container 102*d*, which is located next to the sensor 125, is protruding. The sensor 125 is attached to the other lateral wall 602 of the ink container bay.

Located between the combination of the ink containers 102*a* and 102*b* and the combination of the ink containers 102*c* and 102*d* is a linking mechanism 124 for transmitting the slidable member moving force from the combination of the ink containers 102*a* and 102*b* to the combination of the ink containers 102*c* and 102*d*, and vice versa. The linking mechanism 124 may be made up of an assembly of multiple rod-like members. Only when all the ink containers in the recording apparatus match in ink properties and are correct in terms of the order in which they are to be arranged in the ink container bay, the slidable member displacement force is transmitted by the rod-like members which match, in ink properties, the set of ink containers in the recording apparatus.

FIG. 17(*a*) is a vertical sectional view of the four ink containers 102, their slidable members 112, mechanism for transmitting the slidable member displacement force, slidable member pushing member, and slidable member detection sensor. The four ink containers 112 match in ink properties and are correct in terms of the order in which they are to be arranged based on color. FIG. 17(*b*) is a vertical sectional view of the same components as those in FIG. 17(*a*), except that in FIG. 17(*b*), the force which was applied to displace the slidable member 112*a* has been transmitted to the slidable member 112*d* through the slidable member 112*b*, the slidable member displacement force transmitting mechanism 124, and slidable member 112*d*, having thereby solidly anchoring the ink containers 102 to the ink container bay.

FIG. 17(*c*) is a vertical sectional view of the same components as those in FIG. 17(*a*), except for the ink container 102*e*, which does not match in ink properties and is in the slot for the ink container 102*c*. In this case, the force applied to displace the slidable member 112*a* of the ink container 102*a* has not been transmitted to the slidable member 112*d* of the ink container 102*d*, failing thereby to cause the slidable member 112*d* to protrude. Therefore, it has been detected that at least one of the ink containers in the ink container bay is a wrong one.

As described above, the present invention is applicable even to an ink jet recording apparatus designed so that multiple ink containers are mounted in two or more groups into the multiple ink container bays of the recording apparatus, by providing the ink jet recording apparatus with a slidable member displacement force transmitting mechanism which is appropriately structured for the ink jet recording apparatus. This embodiment also can offers the same effects as those offered by the first embodiment.

(Ink Delivery Method)

As for the type of ink jet recording apparatus to which the present invention is applicable, an ink jet recording apparatus of the so-called "off-carriage type", in which the ink containers are solidly anchored to an area of the recording apparatus, which is away from the recording head mounted on the carriage, and ink is supplied to the recording head through a piece of flexible tube or the like which connects the ink containers and recording head.

Some recording apparatuses of the "off-carriage type" are designed so that as the ink in the recording head is consumed, ink is continuously supplied to the recording head from the ink container, whereas some recording apparatuses of the "off-carriage type" are designed so that the recording head is provided with an ink reservoir in which a relatively small amount of ink is stored, and to which ink is intermittently supplied from the ink container with proper timing. Next, this intermittent ink delivery method will be briefly described.

Figure 18:
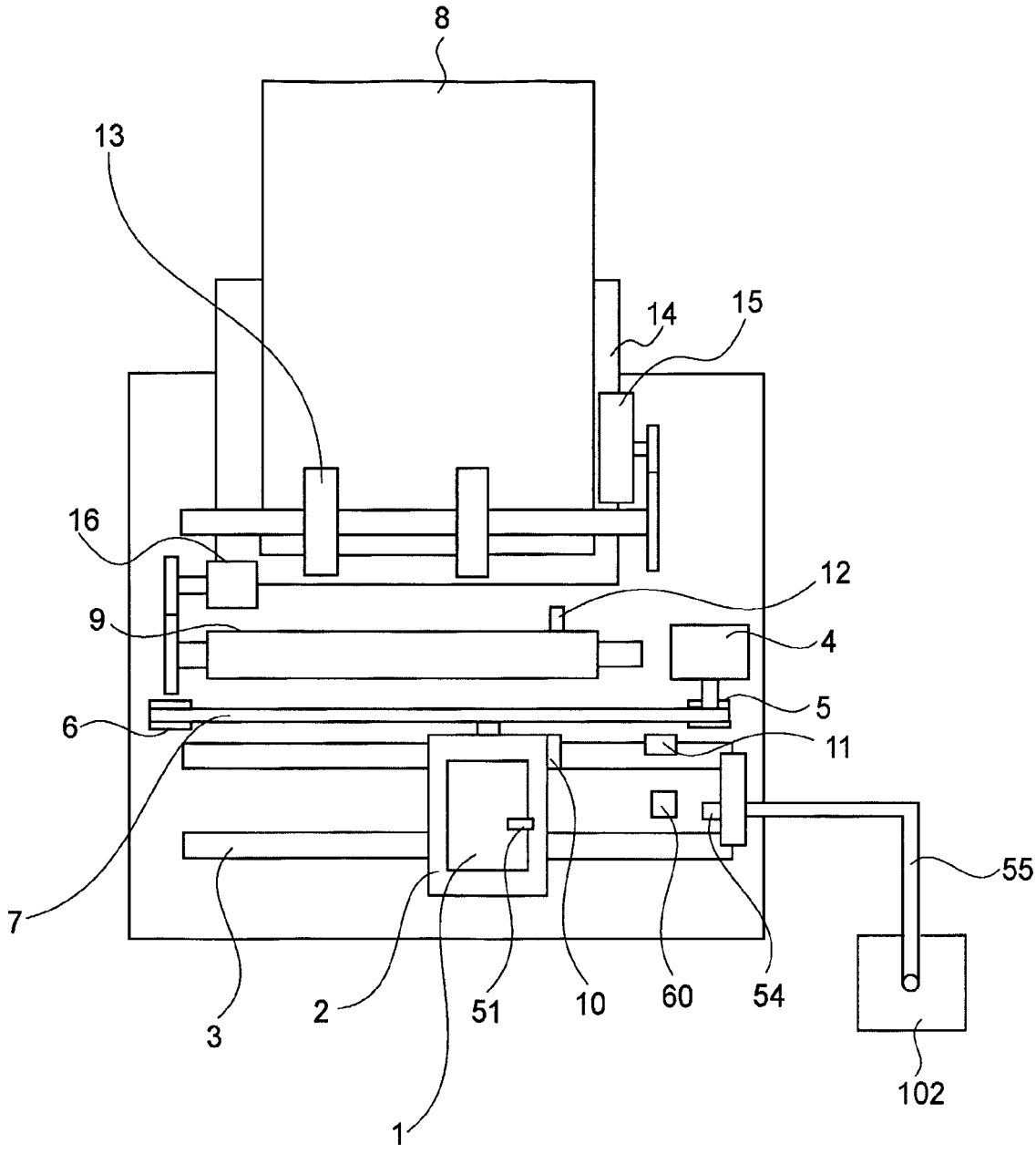
FIG. 18 is a schematic plan view of a recording apparatus of the "off-carriage type", which employs an intermittent ink delivery method, showing the general structure thereof.

FIG. 18 is a schematic plan view of an ink jet recording apparatus employing the intermittent ink delivery method, describing the general structure thereof. For simplification, this drawing shows only one of the ink delivery systems for delivering an ink container to the recording head. Obviously, however, an ink jet recording apparatus is provided with multiple ink delivery systems, the number of which matches the number of the inks, different in color and/or tone, which are used by the recording apparatus.

Referring to FIG. 18, a recording head unit 1 is removably mounted on a carriage 2. The recording head unit 1 is provided with a recording head having an ink jetting portion, and an ink reservoir. The carriage 2 is supported so that it can be reciprocally guided along a guide shaft 3, which is attached to the apparatus main assembly so that it extends in the primary scan direction. Not only is the carriage 2 driven by a primary scan motor 4, but also, is controlled in movement and position, through a transmission mechanism made up of a motor pulley 5, a follower pulley 6, a timing belt 7, etc. Further, the carriage 2 is provided with a home position sensor 10, for example, a photo-interrupter of the transmission type, whereas the portion of the apparatus main assembly, which corresponds to the home position of the carriage, is provided with a blocker plate 11, which is positioned so that it can interrupt the optical axis of the photo-interrupter of the transmission type. Therefore, the movement of the carriage 2 causes the home position sensor 10 to move past the interrupter plate 11. As the home position sensor 10 moves by the interrupter plate 11, the location of the home position mark is detected. The carriage position and movement can be controlled with reference to the detected position of the carriage home position mark.

Sheets of recording medium 8, such as sheets of recording paper or thin plastic plate, are fed, while being separated one by one, from an automatic sheet feeder (which hereafter will be referred to as ASF) 14 into the main assembly of the recording apparatus, by rotating a pickup roller 13 by a sheet feeding-and-conveying motor 15 through a gear train. Then, each sheet of recording medium 8 (which hereafter will be referred to simply as recording medium 8) is conveyed (in secondary scan direction) by the rotation of the conveyance roller 9 through the area (recording area) in which the recording medium 8 squarely faces the surface of the recording head unit 1, which has the ink jetting openings. The conveyance roller 9 is driven by the rotation of the a line feed (LF) motor 16, which is transmitted through a gear train.

During the abovementioned process, whether or not the recording medium 8 has been actually fed into the main assembly is checked based on the output of a paper end sensor 12, and if the recording medium 8 has been, it is registered also based on the output of the paper end sensor 12. The paper end sensor 12 is for detecting the presence (or absence) of the recording medium 8. It is disposed along the recording medium conveyance path, on the upstream side of the abovementioned recording area. Further, as the paper end sensor 12 detects the presence of the trailing end of the recording medium 8, it outputs a detection signal. This detection signal is used for setting the location the final recording line on the recording medium 8 in terms of the secondary scan direction (when to interrupt on-going recording action to move the following recording medium 8 into the recording area).

Incidentally, the recording medium 8 is supported by a platen (unshown) from the bottom side so that the top surface, on which recording is made, is rendered perfectly flat in the recording area. The recording head unit 1 on the carriage 2 is held to the carriage 2 so that the ink jetting side of the recording head unit 1 protrudes downward from the bottom surface of the carriage 2, with the ink jetting surface rendered parallel to the recording medium 8. The recording head unit 1 is an ink jet recording head unit which jets ink with the use of thermal energy, for example, and is provided with electrothermal transducer elements for generating thermal energy necessary to boil ink. That is, the recording head of the recording head 1 records an image by jetting ink from its ink jetting openings with the use of the pressure from the bubbles generated as the thermal energy applied to ink by the abovementioned electrothermal transducer elements. Obviously, the recording head may be an ink jet recording head which jets ink with the use of piezoelectric elements, or any other means capable of jetting ink.

Designated by a referential numeral 60 is a performance restoration mechanism, which has a capping member used for suctioning out ink from the recording head unit 1 to restore the performance of the recording head unit 1, and for protecting the ink jetting surface of the recording head 1. The capping member is movable by an unshown motor, and can be placed in the position in which it contacts the ink jetting surface, and the position in which it is away from the ink jetting surface. In the operation for suctioning out ink from the recording head 1 to restore the recording head performance, or the like operation, the recording head performance is restored by generating negative pressure in the capping member by an unshown suction pump or the like, with the capping member placed in contact with the ink jetting surface. Further, when the recording apparatus is not in use, the ink jetting surface of the recording apparatus can be protected by keeping the capping member in contact therewith.

Designated by a referential numeral 51 is a connective portion on the recording head unit side, which is for delivering ink to the recording head unit 1, whereas designated by a referential numeral 54 is a connective portion on the ink supply side, which corresponds to the connective portion 51. The connective portion 51 is located at the home position of the carriage 2, which is outside the recording area, in terms of the primary scan direction, or the adjacencies thereof. As the two connective portions 51 and 54 bump against each other, they become connected, allowing ink to flow. Designated by a referential numeral 55 is an ink line formed of a piece of tube, which is connected to the ink container 102 to deliver ink to the connective portion 54.

The above described structural arrangement makes it possible to deliver ink from the ink container 102 to the ink reservoir of the recording head unit 1, through the ink line 55, connective portions 51 and 54, by driving the abovementioned pump or the like.

Incidentally, the above described structural arrangement makes the ink delivery system operational only when the recording head unit 1 is in a preset position, such as the home position. Thus, it is sometimes referred to as pit-in type. However, the intermittent ink delivery method is not limited to the pit-in type. For example, it may be of the type in which the recording head unit and ink container remain connected with a connective structure made up of an ink line (ink tube) and a valve, and ink is allowed, or prohibited, to flow from the ink container to the recording head, with proper timing, by opening or closing the valve.

(Miscellanies)

In each of the preceding preferred embodiments of the present invention, the ink jet recording apparatus was structured to use four inks different in color, for example, yellow, magenta, cyan, and black inks. However, it is obvious that the number of inks different in tone (color, density, etc.), and number of ink containers, usable by an ink jet apparatus in accordance with the present invention, are not limited to four. Further, the present invention is also applicable to an ink jet recording apparatus enabled to use light inks, and inks, such as red, green, blue inks, different in color from the ordinary inks, in addition to the ordinary inks. Obviously, an ink jet recording apparatus in accordance with the present invention is also usable with inks different in properties (insusceptibility to ambience, chromaticity, etc.) from the ordinary inks.

The greater the number of inks different in tone or other properties, required for image formation, the greater the number of ink containers different in type, and therefore, the more likely ink containers are mounted in a wrong combination. Therefore, the effects of the present invention may be said to be even more important, from the standpoint of preventing this problem.

Also in each of the preceding preferred embodiment, multiple ink containers were horizontally juxtaposed in a straight line and in parallel. However, the ink container may be vertically arranged. Further, it is not mandatory that all the ink containers are juxtaposed together. If the multiple ink containers are separated into two or more groups, the effects of the present invention can be realized by providing a properly designed linking mechanism which is placed between the adjacent two groups of ink containers. In essence, all that is necessary is that an ink jet recording apparatus and ink containers used therewith are structured so that only when all the ink contains in an ink jet recording apparatus match in terms of the properties of the ink therein, the force applied to displace the displaceable member of the most upstream ink container is sequentially transmitted to the displaceable member of the most downstream ink container, through the displaceable members of the in-between ink containers, although it is preferable that they are structured so that in order for the force applied to the displaceable member of the most upstream ink container to be transmittable to the displaceable member of the most downstream ink container, not only are all the ink contains in an ink jet recording apparatus match in terms of the properties of the ink therein, but also, all the ink containers in the recording apparatus are correctly arranged in terms of the order in which they are to be arranged based on the color of the ink therein.

INDUSTRIAL APPLICABILITY

As described hereinabove, according to the present invention, it is possible to determine whether or not the ink containers in an ink jet recording apparatus match in ink properties, and also, to prevent a wrong operation, such as the careless replacement of the ink containers in the ink jet recording apparatus, with the use of a simple structural arrangement. It is also possible to eliminate the problem that an ink jet recording apparatus is operated when the ink containers in the recording apparatus do not match in ink properties, with the use of a simple structural arrangement.

While the invention has been described with reference to the structures disclosed herein, it is not confined to the details set forth, and this application is intended to cover such modifications or changes as may come within the purposes of the improvements or the scope of the following claims.

The invention claimed is:

1. An ink cartridge detachably mountable to an ink cartridge mounting portion of an ink jet recording apparatus, said ink cartridge comprising:

a structure movable between a position accommodated in said ink cartridge and a position projected outwardly of said ink cartridge;

wherein said structure is capable of projecting outwardly of said ink cartridge when said ink cartridge is correctly mounted and is not capable of projecting outwardly when said ink cartridge is not correctly mounted.

2. An ink cartridge according to claim 1, wherein said structure is in said ink cartridge in a state that said ink cartridge is mountable or dismountable relative to the ink cartridge mounting portion, and is outwardly projected in a state that said ink cartridge is not mountable or dismountable relative thereto.

3. An ink cartridge according to claim 1, wherein said ink cartridge has six sides, and is provided with a penetration path through which said structure is movable, said penetration path extend between one of said sides and a side opposing thereto.

4. An ink cartridge according to claim 1, wherein said ink cartridge is mountable together with another such ink cartridge, and when a combination of said ink cartridge are a predetermined combination, said structures are movable in interrelation with each other, whereas when a combination of said ink cartridges are not the predetermined combination, said structures are not movable in interrelation with each other.

5. An ink cartridge according to claim 4, wherein said structure are displaceable in a direction in which said ink cartridges are arranged.

6. An ink cartridge according to claim 1, further comprising a display portion for visibly displaying whether said is in the mountable state or not.

7. An ink cartridge set comprising:

a plurality of ink cartridges detachably mountable to an ink cartridge mounting portion of an ink jet recording apparatus;

each of said ink cartridges including a structure movable between a position accommodated in said ink cartridge and a position projected outwardly of said ink cartridge;

wherein said structure is capable of projecting outwardly of said ink cartridge when said ink cartridge is correctly mounted and is not capable of projecting outwardly when said ink cartridge is not correctly mounted.

* * * * *